US010632500B2

(12) United States Patent
Berger et al.

(10) Patent No.: US 10,632,500 B2
(45) Date of Patent: Apr. 28, 2020

(54) ULTRASONIC TRANSDUCER WITH A NON-UNIFORM MEMBRANE

(71) Applicant: InvenSense, Inc., San Jose, CA (US)

(72) Inventors: Renata Melamud Berger, Palo Alto, CA (US); Eldwin Ng, District 16 (SG)

(73) Assignee: InvenSense, Inc., San Jose, CA (US)

( * ) Notice: Subject to any disclaimer, the term of this patent is extended or adjusted under 35 U.S.C. 154(b) by 378 days.

(21) Appl. No.: 15/469,383

(22) Filed: Mar. 24, 2017

(65) Prior Publication Data

US 2017/0326594 A1 Nov. 16, 2017

Related U.S. Application Data

(60) Provisional application No. 62/334,408, filed on May 10, 2016.

(51) Int. Cl.

| | |
|---|---|
| ***B06B 1/06*** | (2006.01) |
| ***G10K 13/00*** | (2006.01) |
| ***G10K 9/122*** | (2006.01) |

(52) U.S. Cl.

CPC ..... *B06B 1/0662* (2013.01); *B06B 1/06* (2013.01); *G10K 9/122* (2013.01); *G10K 13/00* (2013.01)

(58) Field of Classification Search

CPC ..... B06B 1/0662; B06B 1/06; G10K 13/00; G10K 9/122

USPC ..... 367/14

See application file for complete search history.

(56) References Cited

U.S. PATENT DOCUMENTS

| | | | |
|---|---|---|---|
| 5,575,286 | A | 11/1996 | Weng et al. |
| 5,684,243 | A | 11/1997 | Gururaja et al. |
| 5,808,967 | A | 9/1998 | Yu et al. |
| 5,867,302 | A | 2/1999 | Fleming |
| 6,071,239 | A | 6/2000 | Cribbs et al. |
| 6,104,673 | A | 8/2000 | Cole et al. |
| 6,289,112 | B1 | 9/2001 | Jain et al. |
| 6,350,652 | B1 | 2/2002 | Libera et al. |
| 6,428,477 | B1 | 8/2002 | Mason |
| 6,500,120 | B1 | 12/2002 | Anthony |

(Continued)

FOREIGN PATENT DOCUMENTS

| | | |
|---|---|---|
| EP | 1214909 A1 | 6/2002 |
| EP | 2884301 A1 | 6/2015 |

(Continued)

OTHER PUBLICATIONS

Tang, et al., "Pulse-Echo Ultrasonic Fingerprint Sensor on a Chip", IEEE Transducers, Anchorage, Alaska, USA, Jun. 21-25, 2015, pp. 674-677.

(Continued)

*Primary Examiner* — Daniel L Murphy

(57) ABSTRACT

A Piezoelectric Micromachined Ultrasonic Transducer (PMUT) device includes a substrate, an edge support structure connected to the substrate, and a membrane connected to the edge support structure such that a cavity is defined between the membrane and the substrate, the membrane configured to allow movement at ultrasonic frequencies, the membrane having non-uniform stiffness. The membrane includes a piezoelectric layer, a first electrode and a second electrode coupled to opposing sides of the piezoelectric layer, and a mechanical support layer coupled to one of the first electrode and the second electrode.

25 Claims, 15 Drawing Sheets

(56) References Cited

U.S. PATENT DOCUMENTS 6,676,602 B1 1/2004 Barnes et al.
6,736,779 B1 5/2004 Sano et al.
7,067,962 B2 6/2006 Scott
7,109,642 B2 9/2006 Scott
7,243,547 B2 7/2007 Cobianu et al.
7,400,750 B2 7/2008 Nam
7,459,836 B2 12/2008 Scott
7,471,034 B2 12/2008 Schlote-Holubek et al.
7,489,066 B2 2/2009 Scott et al.
7,739,912 B2 6/2010 Schneider et al.
8,018,010 B2 9/2011 Tigli et al.
8,139,827 B2 3/2012 Schneider et al.
8,311,514 B2 11/2012 Bandyopadhyay et al.
8,335,356 B2 12/2012 Schmitt
8,433,110 B2 4/2013 Kropp et al.
8,508,103 B2 8/2013 Schmitt et al.
8,515,135 B2 8/2013 Clarke et al.
8,666,126 B2 3/2014 Lee et al.
8,703,040 B2 4/2014 Liufu et al.
8,723,399 B2 5/2014 Sammoura et al.
8,805,031 B2 8/2014 Schmitt
9,056,082 B2 6/2015 Liautaud et al.
9,070,861 B2 6/2015 Bibl et al.
9,224,030 B2 12/2015 Du et al.
9,245,165 B2 1/2016 Slaby et al.
9,424,456 B1 8/2016 Kamath Koteshwara et al.
9,572,549 B2 2/2017 Belevich et al.
9,582,102 B2 2/2017 Setlak
9,607,203 B1 3/2017 Yazdandoost et al.
9,607,206 B2 3/2017 Schmitt et al.
9,613,246 B1 4/2017 Gozzini et al.
9,665,763 B2 5/2017 Du et al.
9,747,488 B2 8/2017 Yazdandoost et al.
9,785,819 B1 10/2017 Oreifej
9,815,087 B2 11/2017 Ganti et al.
9,817,108 B2 11/2017 Kuo et al.
9,818,020 B2 11/2017 Schuckers et al.
9,881,195 B2 1/2018 Lee et al.
9,881,198 B2 1/2018 Lee et al.
9,898,640 B2 2/2018 Ghavanini
9,904,836 B2 2/2018 Yeke Yazdandoost et al.
9,909,225 B2 3/2018 Lee et al.
9,922,235 B2 3/2018 Cho et al.
9,934,371 B2 4/2018 Hong et al.
9,939,972 B2 4/2018 Shepelev et al.
9,953,205 B1 4/2018 Rasmussen et al.
9,959,444 B2 5/2018 Young et al.
9,967,100 B2 5/2018 Hong et al.
9,983,656 B2 5/2018 Merrell et al.
9,984,271 B1 5/2018 King et al.
10,275,638 B1 4/2019 Yousefpor et al.
10,315,222 B2 6/2019 Salvia et al.
10,600,403 B2 3/2020 Garlepp et al.
2002/0135273 A1 9/2002 Mauchamp et al.
2003/0013955 A1 1/2003 Poland
2004/0085858 A1 5/2004 Khuri-Yakub et al.
2004/0122316 A1 6/2004 Satoh et al.
2004/0174773 A1 9/2004 Thomenius et al.
2005/0057284 A1 3/2005 Wodnicki
2005/0100200 A1 5/2005 Abiko et al.
2005/0110071 A1 5/2005 Ema et al.
2005/0146240 A1 7/2005 Smith et al.
2005/0148132 A1 7/2005 Wodnicki et al.
2005/0162040 A1 7/2005 Robert
2006/0052697 A1 3/2006 Hossack et al.
2006/0079777 A1 4/2006 Karasawa
2007/0046396 A1 3/2007 Huang
2007/0047785 A1 3/2007 Jang et al.
2007/0073135 A1 3/2007 Lee et al.
2007/0202252 A1 8/2007 Sasaki
2007/0215964 A1 9/2007 Khuri-Yakub et al.
2007/0230754 A1 10/2007 Jain et al.
2008/0125660 A1 5/2008 Yao et al.
2008/0150032 A1 6/2008 Tanaka
2008/0194053 A1 8/2008 Huang
2008/0240523 A1 10/2008 Benkley et al.
2009/0005684 A1 1/2009 Kristoffersen et al.
2009/0182237 A1 7/2009 Angelsen et al.
2009/0274343 A1 11/2009 Clarke
2009/0303838 A1 12/2009 Svet
2010/0030076 A1 2/2010 Vortman et al.
2010/0046810 A1 2/2010 Yamada
2010/0168583 A1 7/2010 Dausch et al.
2010/0195851 A1 8/2010 Buccafusca
2010/0201222 A1 8/2010 Adachi et al.
2010/0202254 A1 8/2010 Roest et al.
2010/0239751 A1 9/2010 Regniere
2010/0251824 A1 10/2010 Schneider et al.
2010/0256498 A1 10/2010 Tanaka
2010/0278008 A1 11/2010 Ammar
2011/0285244 A1 11/2011 Lewis et al.
2011/0291207 A1 12/2011 Martin et al.
2012/0016604 A1 1/2012 Irving et al.
2012/0092026 A1 4/2012 Liautaud et al.
2012/0095347 A1 4/2012 Adam et al.
2012/0147698 A1 6/2012 Wong et al.
2012/0232396 A1 9/2012 Tanabe
2012/0238876 A1 9/2012 Tanabe et al.
2012/0279865 A1 11/2012 Regniere et al.
2012/0288641 A1 11/2012 Diatezua et al.
2013/0051179 A1 2/2013 Hong
2013/0064043 A1 3/2013 Degertekin et al.
2013/0127592 A1 5/2013 Fyke et al.
2013/0133428 A1 5/2013 Lee et al.
2013/0201134 A1 8/2013 Schneider et al.
2013/0294202 A1 11/2013 Hajati
2014/0060196 A1 3/2014 Falter et al.
2014/0117812 A1 5/2014 Hajati
2014/0176332 A1 6/2014 Alameh et al.
2014/0208853 A1 7/2014 Onishi et al.
2014/0219521 A1 8/2014 Schmitt et al.
2014/0232241 A1 8/2014 Hajati
2014/0265721 A1 9/2014 Robinson et al.
2014/0355387 A1 12/2014 Kitchens et al.
2015/0036065 A1 2/2015 Yousefpor et al.
2015/0049590 A1 2/2015 Rowe et al.
2015/0087991 A1 3/2015 Chen et al.
2015/0097468 A1 4/2015 Hajati et al.
2015/0145374 A1 5/2015 Xu et al.
2015/0164473 A1 6/2015 Kim et al.
2015/0165479 A1 6/2015 Lasiter et al.
2015/0169136 A1 6/2015 Ganti et al.
2015/0189136 A1 7/2015 Chung et al.
2015/0198699 A1 7/2015 Kuo et al.
2015/0206738 A1 7/2015 Rastegar
2015/0213180 A1 7/2015 Herberholz
2015/0220767 A1 8/2015 Yoon et al.
2015/0261261 A1 9/2015 Bhagavatula et al.
2015/0286312 A1 10/2015 Kang et al.
2015/0345987 A1 12/2015 Hajati
2016/0051225 A1 2/2016 Kim et al.
2016/0063294 A1 3/2016 Du et al.
2016/0086010 A1 3/2016 Merrell et al.
2016/0092716 A1 3/2016 Yazdandoost et al.
2016/0100822 A1 4/2016 Kim et al.
2016/0107194 A1 4/2016 Panchawagh et al.
2016/0180142 A1 6/2016 Riddle et al.
2016/0326477 A1* 11/2016 Fernandez-Alcon ..... C12M 23/16
2017/0330552 A1 1/2017 Garlepp et al.
2017/0075700 A1 3/2017 Abudi et al.
2017/0100091 A1 4/2017 Eigil et al.
2017/0110504 A1 4/2017 Panchawagh et al.
2017/0119343 A1 5/2017 Pintoffl
2017/0168543 A1 6/2017 Dai et al.
2017/0185821 A1 6/2017 Chen et al.
2017/0219536 A1 8/2017 Koch et al.
2017/0231534 A1 8/2017 Agassy et al.
2017/0293791 A1 10/2017 Mainguet et al.
2017/0316243 A1 11/2017 Ghavanini
2017/0322290 A1 11/2017 Ng
2017/0322291 A1 11/2017 Salvia et al.
2017/0322292 A1 11/2017 Salvia et al.
2017/0322305 A1 11/2017 Apte et al.

(56) References Cited

U.S. PATENT DOCUMENTS

| | | | |
|---|---|---|---|
| 2017/0323133 | A1 | 11/2017 | Tsai |
| 2017/0326590 | A1 | 11/2017 | Daneman |
| 2017/0326591 | A1 | 11/2017 | Apte et al. |
| 2017/0326593 | A1 | 11/2017 | Garlepp et al. |
| 2017/0328866 | A1 | 11/2017 | Apte et al. |
| 2017/0328870 | A1 | 11/2017 | Garlepp et al. |
| 2017/0330012 | A1 | 11/2017 | Salvia et al. |
| 2017/0330553 | A1 | 11/2017 | Garlepp et al. |
| 2017/0357839 | A1 | 12/2017 | Yazdandoost et al. |
| 2018/0206820 | A1 | 7/2018 | Anand et al. |
| 2018/0349663 | A1 | 12/2018 | Garlepp et al. |
| 2018/0357457 | A1 | 12/2018 | Rasmussen et al. |
| 2018/0369866 | A1 | 12/2018 | Sammoura et al. |
| 2019/0005300 | A1 | 1/2019 | Garlepp et al. |
| 2019/0102046 | A1 | 4/2019 | Miranto et al. |
| 2020/0030850 | A1 | 1/2020 | Apte et al. |

FOREIGN PATENT DOCUMENTS

| | | | |
|---|---|---|---|
| JP | 2011040467 | A | 2/2011 |
| WO | 2009096576 | A2 | 8/2009 |
| WO | 2009137106 | A2 | 11/2009 |
| WO | 2014035564 | A1 | 3/2014 |
| WO | 2015009635 | A1 | 1/2015 |
| WO | 2015112453 | A1 | 7/2015 |
| WO | 2015120132 | A1 | 8/2015 |
| WO | 2015131083 | A1 | 9/2015 |
| WO | 2015183945 | A1 | 12/2015 |
| WO | 2016007250 | A1 | 1/2016 |
| WO | 2016011172 | A1 | 1/2016 |
| WO | 2016040333 | A2 | 3/2016 |
| WO | 2017003848 | A1 | 1/2017 |
| WO | 2017192895 | A1 | 11/2017 |
| WO | 2017196678 | A1 | 11/2017 |
| WO | 2017196682 | A1 | 11/2017 |
| WO | 2017192903 | A3 | 12/2017 |

OTHER PUBLICATIONS

Dausch, et al., "Theory and Operation of 2-D Array Piezoelectric Micromachined Ultrasound Transducers", IEEE Transactions on Ultrasonics, and Frequency Control, vol. 55, No. 11;, Nov. 2008, 2484-2492.

Hopcroft, et al., "Temperature Compensation of a MEMS Resonator Using Quality Factor as a Thermometer", Retrieved from Internet: http://micromachine.stanford.edu/~amanu/linked/MAH_MEMS2006.pdf, 2006, 222-225.

Hopcroft, et al., "Using the temperature dependence of resonator quality factor as a thermometer", Applied Physics Letters 91. Retrieved from Internet: http://micromachine.stanford.edu/~hopcroft/Publications/Hopcroft_QT_ApplPhysLett_91_013505.pdf, 2007, 013505-1-031505-3.

Lee, et al., "Low jitter and temperature stable MEMS oscillators", Frequency Control Symposium (FCS), 2012 IEEE International, May 2012, 1-5.

Li, et al., "Capacitive micromachined ultrasonic transducer for ultra-low pressure measurement: Theoretical study", AIP Advances 5.12. Retrieved from Internet: http://scitation.aip.org/content/aip/journal/adva/5/12/10.1063/1.4939217, 2015, 127231.

Qiu, et al., "Piezoelectric Micromachined Ultrasound Transducer (PMUT) Arrays for Integrated Sensing, Actuation and Imaging", Sensors 15, doi:10.3390/s150408020, Apr. 3, 2015, 8020-8041.

Savoia, et al., "Design and Fabrication of a cMUT Probe for Ultrasound Imaging of Fingerprints", 2010 IEEE International Ultrasonics Symposium Proceedings, Oct. 2010, 1877-1880.

Shen, et al., "Anisotropic Complementary Acoustic Metamaterial for Canceling out Aberrating Layers", American Physical Society, Physical Review X 4.4: 041033., Nov. 19, 2014, 041033-1-041033-7.

Thakar, et al., "Multi-resonator approach to eliminating the temperature dependence of silicon-based timing references", Hilton Head'14. Retrieved from the Internet: http://blog.narotama.ac.id/wp-content/uploads/2014/12/Multi-resonator-approach-to-eliminating-the-temperature-dependance-of-silicon-based-timing-references.pdf, 2014, 415-418.

ISA/EP, International Search Report and Written Opinion for International Application No. PCT/US2017/031120, 12 pages, dated Aug. 29, 2017 (Aug. 29, 2017).

ISA/EP, International Search Report and Written Opinion for International Application No. PCT/US2017/031120, 13 pages, dated Sep. 1, 2017 (Sep. 1, 2017).

ISA/EP, International Search Report and Written Opinion for International Application No. PCT/US2017/031134, 12 pages, dated Aug. 30, 2017 (Aug. 30, 2017).

ISA/EP, International Search Report and Written Opinion for International Application No. PCT/US2017/031421 13 pages, dated Jun. 21, 2017 (Jun. 21, 2017).

ISA/EP, International Search Report and Written Opinion for International Application No. PCT/US2017/031426 13 pages, dated Jun. 22, 2017 (Jun. 22, 2017).

ISA/EP, International Search Report and Written Opinion for International Application No. PCT/US2017/031431, 14 pages, dated Aug. 1, 2017 (Aug. 1, 2017).

ISA/EP, International Search Report and Written Opinion for International Application No. PCT/US2017/031434, 13 pages, dated Jun. 26, 2017 (Jun. 26, 2017).

ISA/EP, International Search Report and Written Opinion for International Application No. PCT/US2017/031439, 10 pages, dated Jun. 20, 2017 (Jun. 20, 2017).

ISA/EP, International Search Report and Written Opinion for International Application No. PCT/US2017/031824, 18 pages, dated Sep. 22, 2017 (Sep. 22, 2017).

ISA/EP, International Search Report and Written Opinion for International Application No. PCT/US2017/031827, 16 pages, dated Aug. 1, 2017 (Aug. 1, 2017).

ISA/EP, International Search Report and Written Opinion for International Application No. PCT/US2017/031831, 12 pages, dated Jul. 21, 2017 (Jul. 21, 2017).

ISA/EP, Partial International Search Report for International Application No. PCT/US2017/031140, 13 pages, dated Aug. 29, 2017 (Aug. 29, 2017).

Rozen, et al., "Air-Coupled Aluminum Nitride Piezoelectric Micromachined Ultrasonic Transducers at 0.3 MHZ to 0.9 MHZ", 2015 28th IEEE International Conference on Micro Electro Mechanical Systems (MEMS), IEEE, Jan. 18, 2015, 921-924.

ISA/EP, International Search Report and Written Opinion for International Application No. PCT/US2017/031140, 18 pages, dated Nov. 2, 2017 (Nov. 2, 2017).

ISA/EP, International Search Report for International Application No. PCT/US2017/031826, 16 pages, dated Feb. 27, 2018 (Feb. 27, 2018).

ISA/EP, Partial International Search Report for International Application No. PCT/US2017/031823, 12 pages, Nov. 30, 2017 (Nov. 30, 2017).

ISA/EP, International Search Report and Written Opinion for International Application # PCT/US2018/063431, pp. 1-15, dated Feb. 5, 2019.

ISA/EP, International Search Report and Written Opinion for International Application # PCT/US2019/015020, pp. 1-23, dated Jul. 1, 2019.

ISA/EP, International Search Report and Written Opinion for International Application # PCT/US2019/023440, pp. 1-10, dated Jun. 4, 2019.

"Moving Average Filters", Waybackmachine XP05547422, Retrieved from the Internet: URL:https://web.archive.org/web/20170809081353/https//www.analog.com/media/en/technical-documentation/dsp-book/dsp_book_Ch15.pdf—[retrieved on Jan. 24, 2019], Aug. 9, 2017, 1-8.

"Receiver Thermal Noise Threshold", Fisher Telecommunication Services, Satellite Communications. Retrieved from the Internet: URL:https://web.archive.org/web/20171027075705/http//www.fishercom.xyz:80/satellite-communications/receiver-thermal-noise-threshold.html, Oct. 27, 2017, 3.

(56) References Cited

OTHER PUBLICATIONS

"Sleep Mode", Wikipedia, Retrieved from the Internet: URL:https://web.archive.org/web/20170908153323/https://en.wikipedia.org/wiki/Sleep_mode [retrieved on Jan. 25, 2019], Sep. 8, 2017, 1-3.
"TMS320C5515 Fingerprint Development Kit (FDK) Hardware Guide", Texas Instruments, Literature No. SPRUFX3, XP055547651, Apr. 2010, 1-26.
"ZTE V7 MAX. 5,5" smartphone on MediaTeck Helio P10 cpu; Published on Apr. 20, 2016; https://www.youtube.com/watch?v=ncNCbpkGQzU (Year: 2016).
Cappelli, et al., "Fingerprint Image Reconstruction from Standard Templates", IEEE Transactions on Pattern Analysis and Machine Intelligence, IEEE Computer Society, vol. 29, No. 9, Sep. 2007, 1489-1503.
Feng, et al., "Fingerprint Reconstruction: From Minutiae to Phase", IEEE Transactions on Pattern Analysis and Machine Intelligence, IEEE Computer Society, vol. 33, No. 2, Feb. 2011, 209-223.
Kumar, et al., "Towards Contactless, Low-Cost and Accurate 3D Fingerprint Identification", IEEE Transactions on Pattern Analysis and Machine Intelligence, IEEE Computer Society, vol. 37, No. 3, Mar. 2015, 681-696.
Pang, et al., "Extracting Valley-Ridge Lines from Point-Cloud-Based 3D Fingerprint Models", IEEE Computer Graphics and Applications, IEEE Service Center, New York, vol. 33, No. 4, Jul./Aug. 2013, 73-81.
Ross, et al., "From Template to Image: Reconstructing Fingerprints from Minutiae Points", IEEE Transactions on Pattern Analysis and Machine Intelligence, IEEE Computer Society, vol. 29, No. 4, Apr. 2007, 544-560.
Zhou, et al., "Partial Fingerprint Reconstruction with Improved Smooth Extension", Network and System Security, Springer Berlin Heidelberg, Jun. 3, 2013, 756-762.

* cited by examiner

ULTRASONIC TRANSDUCER WITH A NON-UNIFORM MEMBRANE

RELATED APPLICATIONS

This application claims also priority to and the benefit of U.S. Provisional Patent Application 62/334,408, filed on May 10, 2016, entitled "ULTRASONIC TRANSDUCERS USING NON-UNIFORM MEMBRANES," by Renata Berger, and assigned to the assignee of the present application, which is incorporated herein by reference in its entirety.

BACKGROUND

Piezoelectric materials facilitate conversion between mechanical energy and electrical energy. Moreover, a piezoelectric material can generate an electrical signal when subjected to mechanical stress, and can vibrate when subjected to an electrical voltage. Piezoelectric materials are widely utilized in piezoelectric ultrasonic transducers to generate acoustic waves based on an actuation voltage applied to electrodes of the piezoelectric ultrasonic transducer.

BRIEF DESCRIPTION OF THE DRAWINGS

The accompanying drawings, which are incorporated in and form a part of the Description of Embodiments, illustrate various embodiments of the subject matter and, together with the Description of Embodiments, serve to explain principles of the subject matter discussed below. Unless specifically noted, the drawings referred to in this Brief Description of Drawings should be understood as not being drawn to scale. Herein, like items are labeled with like item numbers.

DESCRIPTION OF EMBODIMENTS

Figure 1:
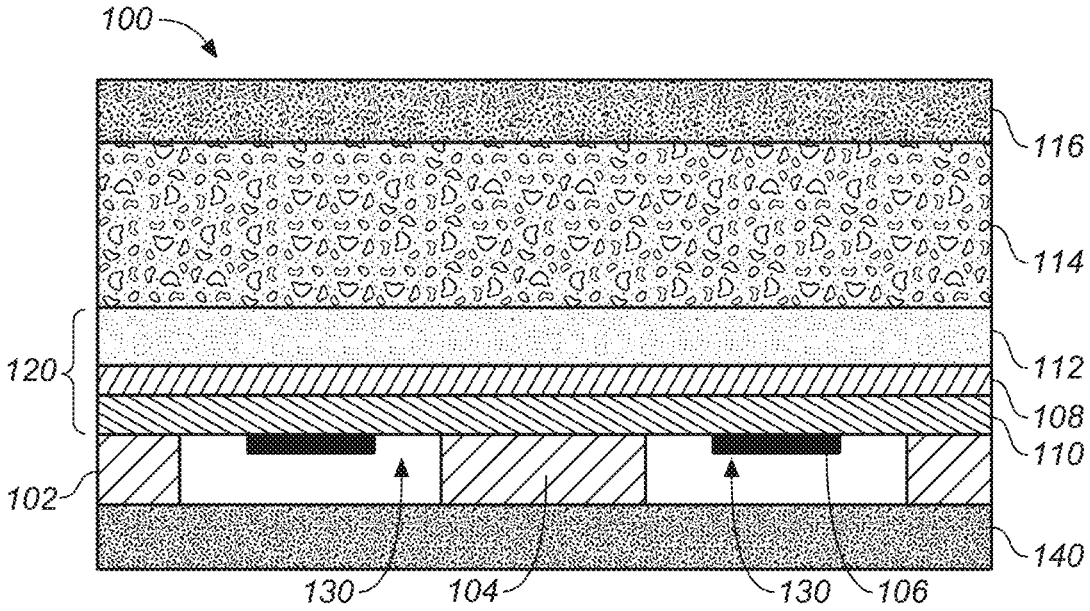
FIG. 1 is a diagram illustrating a piezoelectric micromachined ultrasonic transducer (PMUT) device having a center pinned membrane, according to some embodiments.

The following Description of Embodiments is merely provided by way of example and not of limitation. Furthermore, there is no intention to be bound by any expressed or implied theory presented in the preceding background or in the following Description of Embodiments.

Reference will now be made in detail to various embodiments of the subject matter, examples of which are illustrated in the accompanying drawings. While various embodiments are discussed herein, it will be understood that they are not intended to limit to these embodiments. On the contrary, the presented embodiments are intended to cover alternatives, modifications and equivalents, which may be included within the spirit and scope the various embodiments as defined by the appended claims. Furthermore, in this Description of Embodiments, numerous specific details are set forth in order to provide a thorough understanding of embodiments of the present subject matter. However, embodiments may be practiced without these specific details. In other instances, well known methods, procedures, components, and circuits have not been described in detail as not to unnecessarily obscure aspects of the described embodiments.

Notation and Nomenclature

Some portions of the detailed descriptions which follow are presented in terms of procedures, logic blocks, processing and other symbolic representations of operations on data within an electrical device. These descriptions and representations are the means used by those skilled in the data processing arts to most effectively convey the substance of their work to others skilled in the art. In the present application, a procedure, logic block, process, or the like, is conceived to be one or more self-consistent procedures or instructions leading to a desired result. The procedures are those requiring physical manipulations of physical quantities. Usually, although not necessarily, these quantities take the form of acoustic (e.g., ultrasonic) signals capable of being transmitted and received by an electronic device and/or electrical or magnetic signals capable of being stored, transferred, combined, compared, and otherwise manipulated in an electrical device.

It should be borne in mind, however, that all of these and similar terms are to be associated with the appropriate physical quantities and are merely convenient labels applied to these quantities. Unless specifically stated otherwise as apparent from the following discussions, it is appreciated that throughout the description of embodiments, discussions utilizing terms such as "adjusting" "determining," "controlling," "activating," "detecting," "interacting," "capturing," "sensing," "generating," "imaging," "performing," "comparing," "updating," "transmitting," "sensing," or the like, refer to the actions and processes of an electronic device such as an electrical device.

Embodiments described herein may be discussed in the general context of processor-executable instructions residing on some form of non-transitory processor-readable medium, such as program modules, executed by one or more computers or other devices. Generally, program modules include routines, programs, objects, components, data structures, etc., that perform particular tasks or implement particular abstract data types. The functionality of the program modules may be combined or distributed as desired in various embodiments.

In the figures, a single block may be described as performing a function or functions; however, in actual practice, the function or functions performed by that block may be performed in a single component or across multiple components, and/or may be performed using hardware, using software, or using a combination of hardware and software. To clearly illustrate this interchangeability of hardware and software, various illustrative components, blocks, modules, logic, circuits, and steps have been described generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure. Also, the example fingerprint sensing system and/or mobile electronic device described herein may include components other than those shown, including well-known components.

Various techniques described herein may be implemented in hardware, software, firmware, or any combination thereof, unless specifically described as being implemented in a specific manner. Any features described as modules or components may also be implemented together in an integrated logic device or separately as discrete but interoperable logic devices. If implemented in software, the techniques may be realized at least in part by a non-transitory processor-readable storage medium comprising instructions that, when executed, perform one or more of the methods described herein. The non-transitory processor-readable data storage medium may form part of a computer program product, which may include packaging materials.

The non-transitory processor-readable storage medium may comprise random access memory (RAM) such as synchronous dynamic random access memory (SDRAM), read only memory (ROM), non-volatile random access memory (NVRAM), electrically erasable programmable read-only memory (EEPROM), FLASH memory, other known storage media, and the like. The techniques additionally, or alternatively, may be realized at least in part by a processor-readable communication medium that carries or communicates code in the form of instructions or data structures and that can be accessed, read, and/or executed by a computer or other processor.

Various embodiments described herein may be executed by one or more processors, such as one or more motion processing units (MPUs), sensor processing units (SPUs), host processor(s) or core(s) thereof, digital signal processors (DSPs), general purpose microprocessors, application specific integrated circuits (ASICs), application specific instruction set processors (ASIPs), field programmable gate arrays (FPGAs), a programmable logic controller (PLC), a complex programmable logic device (CPLD), a discrete gate or transistor logic, discrete hardware components, or any combination thereof designed to perform the functions described herein, or other equivalent integrated or discrete logic circuitry. The term "processor," as used herein may refer to any of the foregoing structures or any other structure suitable for implementation of the techniques described herein. As it employed in the subject specification, the term "processor" can refer to substantially any computing processing unit or device comprising, but not limited to comprising, single-core processors; single-processors with software multithread execution capability; multi-core processors; multi-core processors with software multithread execution capability; multi-core processors with hardware multithread technology; parallel platforms; and parallel platforms with distributed shared memory. Moreover, processors can exploit nano-scale architectures such as, but not limited to, molecular and quantum-dot based transistors, switches and gates, in order to optimize space usage or enhance performance of user equipment. A processor may also be implemented as a combination of computing processing units.

In addition, in some aspects, the functionality described herein may be provided within dedicated software modules or hardware modules configured as described herein. Also, the techniques could be fully implemented in one or more circuits or logic elements. A general purpose processor may be a microprocessor, but in the alternative, the processor may be any conventional processor, controller, microcontroller, or state machine. A processor may also be implemented as a combination of computing devices, e.g., a combination of an SPU/MPU and a microprocessor, a plurality of microprocessors, one or more microprocessors in conjunction with an SPU core, MPU core, or any other such configuration.

Overview of Discussion

Discussion begins with a description of an example piezoelectric micromachined ultrasonic transducer (PMUT), in accordance with various embodiments. Example arrays including PMUT devices are then described. Example operations of example arrays of ultrasonic transducers (e.g., PMUT devices) are then further described. Examples of an ultrasonic transducer (e.g., a PMUT device) including a non-uniform membrane, are then described.

A conventional piezoelectric ultrasonic transducer able to generate and detect pressure waves can include a membrane with the piezoelectric material, a supporting layer, and electrodes combined with a cavity beneath the electrodes. Miniaturized versions are referred to as PMUTs. Typical PMUTs use an edge anchored membrane or diaphragm that maximally oscillates at or near the center of the membrane at a resonant frequency (1) proportional to $h/a^2$, where h is the thickness, and a is the radius of the membrane. Higher frequency membrane oscillations can be created by increasing the membrane thickness, decreasing the membrane radius, or both. Increasing the membrane thickness has its limits, as the increased thickness limits the displacement of the membrane. Reducing the PMUT membrane radius also has limits, because a larger percentage of PMUT membrane area is used for edge anchoring.

Embodiments described herein relate to a PMUT device for ultrasonic wave generation and sensing. In accordance with various embodiments, an array of such PMUT devices is described. The PMUT includes a substrate and an edge support structure connected to the substrate. In one embodiment, a non-uniform membrane is connected to the edge support structure such that a cavity is defined between the membrane and the substrate, where the non-uniform membrane is configured to allow movement at ultrasonic frequencies. In accordance with the described embodiments, a non-uniform membrane comprises regions of different stiffness, such that the different regions have different mechanical and flexural properties. In various embodiments, the non-uniform membrane includes a mechanical support layer (e.g., a stiffening layer), a piezoelectric layer and first and second electrodes coupled to opposing sides of the piezoelectric layer.

In accordance with various embodiments, the edge support structure of the PMUT device is structurally compliant to provide for non-uniform movement of the membrane. In such embodiments, the membrane itself may be uniform or non-uniform. In some embodiments, an interior support structure is disposed within the cavity and connected to the substrate and the membrane. The interior support structure may also be structurally compliant to allow for non-uniform movement of the membrane.

It should be appreciated that the embodiments described herein provide for non-uniform displacement of the membrane of an ultrasonic transducer (e.g., a PMUT). For example, the non-uniform movement may be achieved through a non-uniform membrane (e.g., a membrane including regions of different stiffness), structurally compliant edge supports, and structurally compliant interior supports, either alone or in any combination. In various embodiments, the acoustic output and the frequency of a PMUT are designed by controlling the physical properties of various components of the PMUT device, such as the membrane, the edge supports and the interior supports.

The described PMUT device and array of PMUT devices can be used for generation of acoustic signals or measurement of acoustically sensed data in various applications, such as, but not limited to, medical applications, security systems, biometric systems (e.g., fingerprint sensors and/or motion/gesture recognition sensors), mobile communication systems, industrial automation systems, consumer electronic devices, robotics, etc. In one embodiment, the PMUT device can facilitate ultrasonic signal generation and sensing (transducer). Moreover, embodiments described herein provide a sensing component including a silicon wafer having a two-dimensional (or one-dimensional) array of ultrasonic transducers.

Embodiments described herein provide a PMUT that operates at a high frequency for reduced acoustic diffraction through high acoustic velocity materials (e.g., glass, metal), and for shorter pulses so that spurious reflections can be time-gated out. Embodiments described herein also provide a PMUT that has a low quality factor providing a shorter ring-up and ring-down time to allow better rejection of spurious reflections by time-gating. Embodiments described herein also provide a PMUT that has a high fill-factor providing for large transmit and receive signals.

In accordance with various embodiments, a PMUT device includes a substrate, an edge support structure connected to the substrate, and a membrane connected to the edge support structure such that a cavity is defined between the membrane and the substrate, the membrane configured to allow movement at ultrasonic frequencies, the membrane having non-uniform stiffness. The membrane includes a piezoelectric layer, a first electrode and a second electrode coupled to opposing sides of the piezoelectric layer, and a mechanical support layer coupled to one of the first electrode and the second electrode.

In one embodiment, a first region of the membrane has a first stiffness and a second region of the membrane has a second stiffness. In one embodiment, the first region of the membrane is a peripheral region and the second region of the membrane is an interior region. In one embodiment, a thickness of the first region of the membrane is different than a thickness of the second region of the membrane. In one embodiment, the mechanical support layer defines a continuous layer, and wherein a thickness of the mechanical support layer of the first region of the membrane is different than a thickness of the mechanical support layer of the second region of the membrane. In one embodiment, the first region of the membrane includes a void, such that the first stiffness is less than the second stiffness. In one embodiment, the second region of the membrane includes a void, such that the second stiffness is less than the first stiffness. In one embodiment, the first region of the membrane includes a material not comprised within the second region of the membrane. In one embodiment, the second region of the membrane includes a material not comprised within the first region of the membrane.

In one embodiment, the membrane further includes a compliant anchor disposed within the peripheral region of the membrane such that the membrane is connected to the edge support structure via the compliant anchor, the compliant anchor having the first stiffness. In one embodiment, the compliant anchor includes a different material makeup than a portion of the membrane not comprising the compliant anchor. In one embodiment, the edge support structure is structurally compliant. In one embodiment, the PMUT further includes an interior support structure disposed within the cavity and connected to the substrate and the membrane. In one embodiment, the interior support structure is structurally compliant. In one embodiment, the membrane is non-planar.

In accordance with one embodiment, a PMUT device includes a substrate, a structurally compliant edge support structure connected to the substrate, and a membrane connected to the structurally compliant edge support structure such that a cavity is defined between the membrane and the substrate, the membrane configured to allow movement at ultrasonic frequencies, wherein the structurally compliant edge support structure provides for non-uniform movement of the membrane. The membrane includes a piezoelectric layer, a first electrode and a second electrode coupled to opposing sides of the piezoelectric layer, and a mechanical support layer coupled to one of the first electrode and the second electrode.

In one embodiment, the structurally compliant edge support structure includes a compliant anchor for providing the non-uniform movement of the membrane. In one embodiment, the structurally compliant edge support structure includes voids. In one embodiment, the membrane has non-uniform stiffness. In one embodiment, the PMUT further includes an interior support structure disposed within the cavity and connected to the substrate and the membrane. In one embodiment, the interior support structure is structurally compliant.

In accordance with various embodiments, a PMUT array includes a plurality of PMUT devices, wherein at least one PMUT device of the plurality of PMUT devices includes a substrate, an edge support structure connected to the substrate, and a membrane connected to the edge support structure such that a cavity is defined between the membrane and the substrate, the membrane configured to allow movement at ultrasonic frequencies, the membrane having non-uniform stiffness. The membrane includes a piezoelectric layer, a first electrode and a second electrode coupled to opposing sides of the piezoelectric layer, and a mechanical support layer coupled to one of the first electrode and the second electrode. The PMUT array further includes an acoustic coupling layer overlying the plurality of PMUT devices.

In one embodiment, a peripheral region of the membrane has a first stiffness and an interior region of the membrane has a second stiffness. In one embodiment, a thickness of the peripheral region of the membrane is different than a thickness of the interior region of the membrane. In one embodiment, the peripheral region of the membrane includes a material not comprised within the interior region of the membrane. In one embodiment, the interior region of the membrane includes a material not comprised within the peripheral region of the membrane.

In one embodiment, the at least one PMUT device further includes a compliant anchor disposed within the peripheral region of the membrane such that the membrane is connected to the edge support structure via the compliant anchor, the compliant anchor having a third stiffness. In one embodiment, the at least one PMUT device of the plurality of PMUT devices further includes an interior support structure disposed within the cavity and connected to the substrate and the membrane.

Piezoelectric Micromachined Ultrasonic Transducer (PMUT)

Systems and methods disclosed herein, provide efficient structures for an acoustic transducer (e.g., a piezoelectric micromachined actuated transducer or PMUT). One or more embodiments are now described with reference to the drawings, wherein like reference numerals are used to refer to like elements throughout. In the following description, for purposes of explanation, numerous specific details are set forth in order to provide a thorough understanding of the various embodiments. It may be evident, however, that the various embodiments can be practiced without these specific details. In other instances, well-known structures and devices are shown in block diagram form in order to facilitate describing the embodiments in additional detail.

As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form. In addition, the word "coupled" is used herein to mean direct or indirect electrical or mechanical coupling. In addition, the word "example" is used herein to mean serving as an example, instance, or illustration.

FIG. 1 is a diagram illustrating a PMUT device 100 having a center pinned membrane, according to some embodiments. PMUT device 100 includes an interior pinned membrane 120 positioned over a substrate 140 to define a cavity 130. In one embodiment, membrane 120 is attached both to a surrounding edge support 102 and interior support 104. In one embodiment, edge support 102 is connected to an electric potential. Edge support 102 and interior support 104 may be made of electrically conducting materials, such as and without limitation, aluminum, molybdenum, or titanium. Edge support 102 and interior support 104 may also be made of dielectric materials, such as silicon dioxide, silicon nitride or aluminum oxide that have electrical connections on the sides or in vias through edge support 102 or interior support 104, electrically coupling lower electrode 106 to electrical wiring in substrate 140.

In one embodiment, both edge support 102 and interior support 104 are attached to a substrate 140. In various embodiments, substrate 140 may include at least one of, and without limitation, silicon or silicon nitride. It should be appreciated that substrate 140 may include electrical wirings and connection, such as aluminum or copper. In one embodiment, substrate 140 includes a CMOS logic wafer bonded to edge support 102 and interior support 104. In one embodiment, the membrane 120 comprises multiple layers. In an example embodiment, the membrane 120 includes lower electrode 106, piezoelectric layer 110, and upper electrode 108, where lower electrode 106 and upper electrode 108 are coupled to opposing sides of piezoelectric layer 110. As shown, lower electrode 106 is coupled to a lower surface of piezoelectric layer 110 and upper electrode 108 is coupled to an upper surface of piezoelectric layer 110. It should be appreciated that, in various embodiments, PMUT device 100 is a microelectromechanical (MEMS) device.

In one embodiment, membrane 120 also includes a mechanical support layer 112 (e.g., stiffening layer) to mechanically stiffen the layers. In various embodiments, mechanical support layer 112 may include at least one of, and without limitation, silicon, silicon oxide, silicon nitride, aluminum, molybdenum, titanium, etc. In one embodiment, PMUT device 100 also includes an acoustic coupling layer 114 above membrane 120 for supporting transmission of acoustic signals. It should be appreciated that acoustic coupling layer can include air, liquid, gel-like materials, epoxy, or other materials for supporting transmission of acoustic signals. In one embodiment, PMUT device 100 also includes platen layer 116 above acoustic coupling layer 114 for containing acoustic coupling layer 114 and providing a contact surface for a finger or other sensed object with PMUT device 100. It should be appreciated that, in various embodiments, acoustic coupling layer 114 provides a contact surface, such that platen layer 116 is optional. Moreover, it should be appreciated that acoustic coupling layer 114 and/or platen layer 116 may be included with or used in conjunction with multiple PMUT devices. For example, an array of PMUT devices may be coupled with a single acoustic coupling layer 114 and/or platen layer 116.

Figure 2:
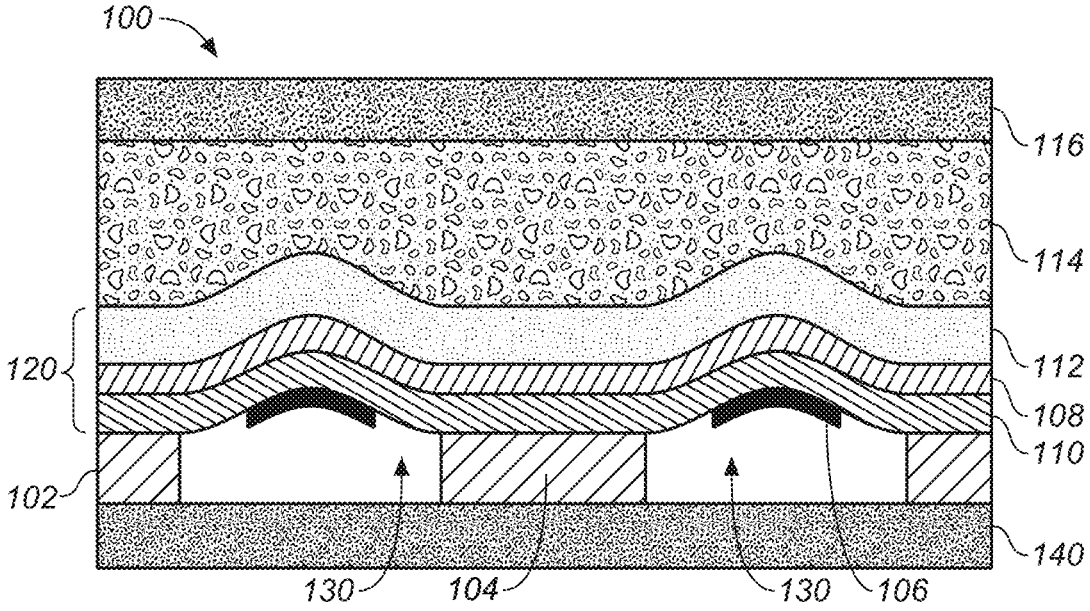
FIG. 2 is a diagram illustrating an example of membrane movement during activation of a PMUT device, according to some embodiments.

FIG. 2 is a diagram illustrating an example of membrane movement during activation of PMUT device 100, according to some embodiments. As illustrated with respect to FIG. 2, in operation, responsive to an object proximate platen layer 116, the electrodes 106 and 108 deliver a high frequency electric charge to the piezoelectric layer 110, causing those portions of the membrane 120 not pinned to the surrounding edge support 102 or interior support 104 to be displaced upward into the acoustic coupling layer 114. This generates a pressure wave that can be used for signal probing of the object. Return echoes can be detected as pressure waves causing movement of the membrane, with compression of the piezoelectric material in the membrane causing an electrical signal proportional to amplitude of the pressure wave.

The described PMUT device 100 can be used with almost any electrical device that converts a pressure wave into mechanical vibrations and/or electrical signals. In one embodiment, the PMUT device 100 can comprise an acoustic sensing element (e.g., a piezoelectric element) that generates and senses ultrasonic sound waves. An object in a path of the generated sound waves can create a disturbance (e.g., changes in frequency or phase, reflection signal, echoes, etc.) that can then be sensed. The interference can be analyzed to determine physical parameters such as (but not limited to) distance, density and/or speed of the object. As an example, the PMUT device 100 can be utilized in various applications, such as, but not limited to, fingerprint or physiologic sensors suitable for wireless devices, industrial systems, automotive systems, robotics, telecommunications, security, medical devices, etc. For example, the PMUT device 100 can be part of a sensor array comprising a plurality of ultrasonic transducers deposited on a wafer, along with various logic, control and communication electronics. A sensor array may comprise homogenous or identical PMUT devices 100, or a number of different or heterogonous device structures.

In various embodiments, the PMUT device 100 employs a piezoelectric layer 110, comprised of materials such as, but not limited to, Aluminum nitride (AlN), lead zirconate titanate (PZT), quartz, polyvinylidene fluoride (PVDF), and/or zinc oxide, to facilitate both acoustic signal production and sensing. The piezoelectric layer 110 can generate electric charges under mechanical stress and conversely experience a mechanical strain in the presence of an electric field. For example, the piezoelectric layer 110 can sense mechanical vibrations caused by an ultrasonic signal and produce an electrical charge at the frequency (e.g., ultrasonic frequency) of the vibrations. Additionally, the piezoelectric layer 110 can generate an ultrasonic wave by vibrating in an oscillatory fashion that might be at the same frequency (e.g., ultrasonic frequency) as an input current generated by an alternating current (AC) voltage applied across the piezoelectric layer 110. It should be appreciated that the piezoelectric layer 110 can include almost any material (or combination of materials) that exhibits piezoelectric properties, such that the structure of the material does not have a center of symmetry and a tensile or compressive stress applied to the material alters the separation between positive and negative charge sites in a cell causing a polarization at the surface of the material. The polarization is directly proportional to the applied stress and is direction dependent so that compressive and tensile stresses results in electric fields of opposite polarizations.

Figure 10:
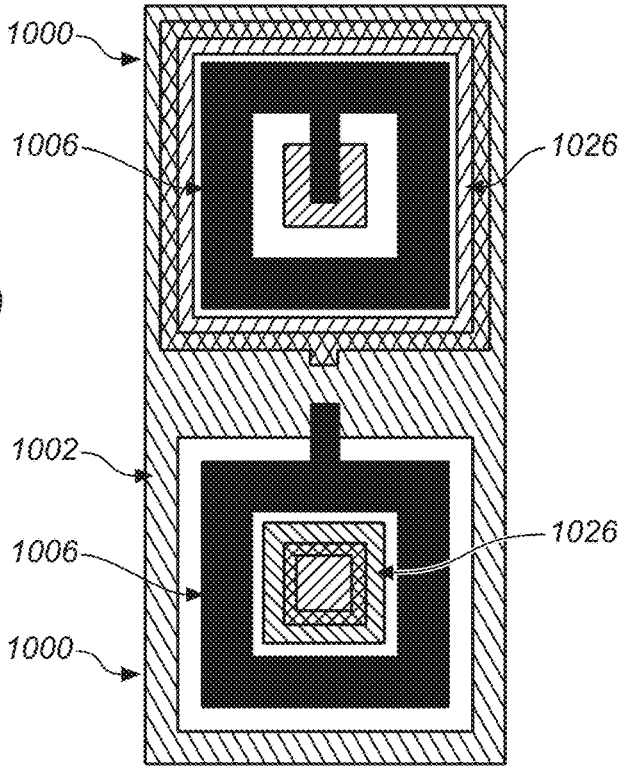
FIG. 10 illustrates an example pair of PMUT devices in a PMUT array, with each PMUT having differing electrode patterning, according to some embodiments.

Further, the PMUT device 100 comprises electrodes 106 and 108 that supply and/or collect the electrical charge to/from the piezoelectric layer 110. It should be appreciated that electrodes 106 and 108 can be continuous and/or patterned electrodes (e.g., in a continuous layer and/or a patterned layer). For example, as illustrated, electrode 106 is a patterned electrode and electrode 108 is a continuous electrode. As an example, electrodes 106 and 108 can be comprised of almost any metal layers, such as, but not limited to, Aluminum (Al)/Titanium (Ti), Molybdenum (Mo), etc., which are coupled with and on opposing sides of the piezoelectric layer 110. In one embodiment, PMUT device also includes a third electrode, as illustrated in FIG. 10 and described below.

According to an embodiment, the acoustic impedance of acoustic coupling layer 114 is selected to be similar to the acoustic impedance of the platen layer 116, such that the acoustic wave is efficiently propagated to/from the membrane 120 through acoustic coupling layer 114 and platen layer 116. As an example, the platen layer 116 can comprise various materials having an acoustic impedance in the range between 0.8 to 4 MRayl, such as, but not limited to, plastic, resin, rubber, Teflon, epoxy, etc. In another example, the platen layer 116 can comprise various materials having a high acoustic impedance (e.g., an acoustic impendence greater than 10 MiRayl), such as, but not limited to, glass, aluminum-based alloys, sapphire, etc. Typically, the platen layer 116 can be selected based on an application of the sensor. For instance, in fingerprinting applications, platen layer 116 can have an acoustic impedance that matches (e.g., exactly or approximately) the acoustic impedance of human skin (e.g., $1.6\times10^6$ Rayl). Further, in one embodiment, the platen layer 116 can further include a thin layer of anti-scratch material. In various embodiments, the anti-scratch layer of the platen layer 116 is less than the wavelength of the acoustic wave that is to be generated and/or sensed to provide minimum interference during propagation of the acoustic wave. As an example, the anti-scratch layer can comprise various hard and scratch-resistant materials (e.g., having a Mohs hardness of over 7 on the Mohs scale), such as, but not limited to sapphire, glass, MN, Titanium nitride (TiN), Silicon carbide (SiC), diamond, etc. As an example, PMUT device 100 can operate at 20 MHz and accordingly, the wavelength of the acoustic wave propagating through the acoustic coupling layer 114 and platen layer 116 can be 70-150 microns. In this example scenario, insertion loss can be reduced and acoustic wave propagation efficiency can be improved by utilizing an anti-scratch layer having a thickness of 1 micron and the platen layer 116 as a whole having a thickness of 1-2 millimeters. It is noted that the term "anti-scratch material" as used herein relates to a material that is resistant to scratches and/or scratch-proof and provides substantial protection against scratch marks.

In accordance with various embodiments, the PMUT device 100 can include metal layers (e.g., Aluminum (Al)/Titanium (Ti), Molybdenum (Mo), etc.) patterned to form electrode 106 in particular shapes (e.g., ring, circle, square, octagon, hexagon, etc.) that are defined in-plane with the membrane 120. Electrodes can be placed at a maximum strain area of the membrane 120 or placed at close to either or both the surrounding edge support 102 and interior support 104. Furthermore, in one example, electrode 108 can be formed as a continuous layer providing a ground plane in contact with mechanical support layer 112, which can be formed from silicon or other suitable mechanical stiffening material. In still other embodiments, the electrode 106 can be routed along the interior support 104, advantageously reducing parasitic capacitance as compared to routing along the edge support 102.

For example, when actuation voltage is applied to the electrodes, the membrane 120 will deform and move out of plane. The motion then pushes the acoustic coupling layer 114 it is in contact with and an acoustic (ultrasonic) wave is generated. Oftentimes, vacuum is present inside the cavity 130 and therefore damping contributed from the media within the cavity 130 can be ignored. However, the acoustic coupling layer 114 on the other side of the membrane 120 can substantially change the damping of the PMUT device 100. For example, a quality factor greater than 20 can be observed when the PMUT device 100 is operating in air with atmosphere pressure (e.g., acoustic coupling layer 114 is air) and can decrease lower than 2 if the PMUT device 100 is operating in water (e.g., acoustic coupling layer 114 is water).

Figure 3:
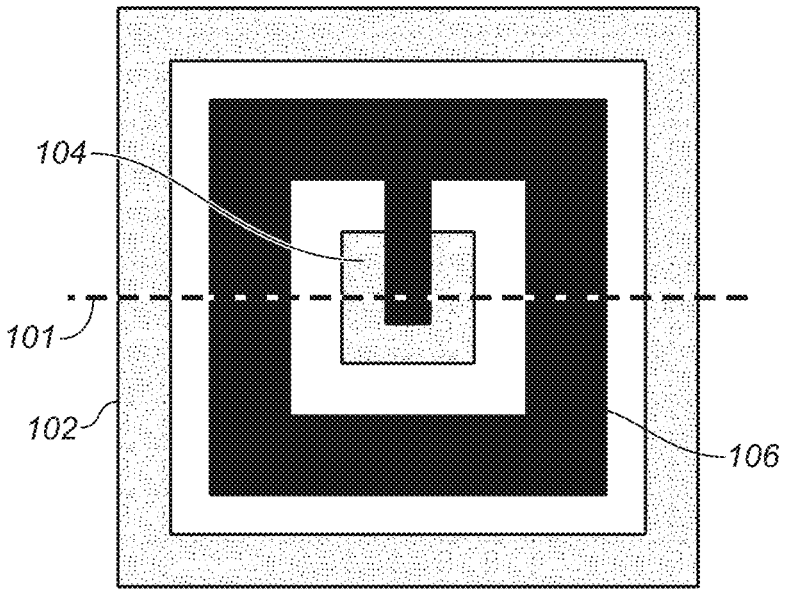
FIG. 3 is a top view of the PMUT device of FIG. 1, according to some embodiments.

FIG. 3 is a top view of the PMUT device 100 of FIG. 1 having a substantially square shape, which corresponds in part to a cross section along dotted line 101 in FIG. 3. Layout of surrounding edge support 102, interior support 104, and lower electrode 106 are illustrated, with other continuous layers not shown. It should be appreciated that the term "substantially" in "substantially square shape" is intended to convey that a PMUT device 100 is generally square-shaped, with allowances for variations due to manufacturing processes and tolerances, and that slight deviation from a square shape (e.g., rounded corners, slightly wavering lines, deviations from perfectly orthogonal corners or intersections, etc.) may be present in a manufactured device. While a generally square arrangement PMUT device is shown, alternative embodiments including rectangular, hexagon, octagonal, circular, or elliptical are contemplated. In other embodiments, more complex electrode or PMUT device shapes can be used, including irregular and non-symmetric layouts such as chevrons or pentagons for edge support and electrodes.

Figure 4:
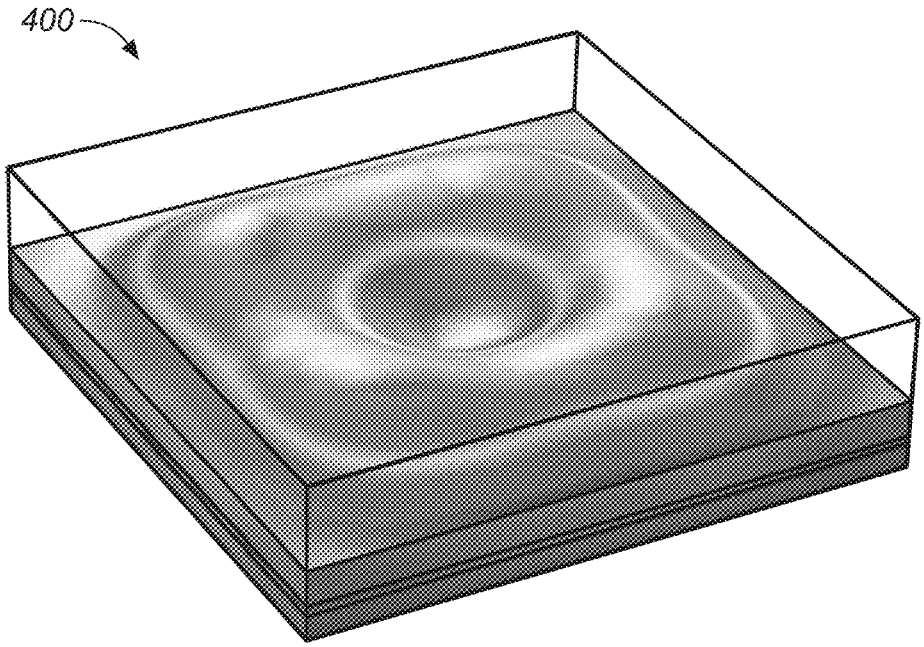
FIG. 4 is a simulated map illustrating maximum vertical displacement of the membrane of the PMUT device shown in FIGS. 1-3, according to some embodiments.

FIG. 4 is a simulated topographic map 400 illustrating maximum vertical displacement of the membrane 120 of the PMUT device 100 shown in FIGS. 1-3. As indicated, maximum displacement generally occurs along a center axis of the lower electrode, with corner regions having the greatest displacement. As with the other figures, FIG. 4 is not drawn to scale with the vertical displacement exaggerated for illustrative purposes, and the maximum vertical displacement is a fraction of the horizontal surface area comprising the PMUT device 100. In an example PMUT device 100, maximum vertical displacement may be measured in nanometers, while surface area of an individual PMUT device 100 may be measured in square microns.

Figure 5:
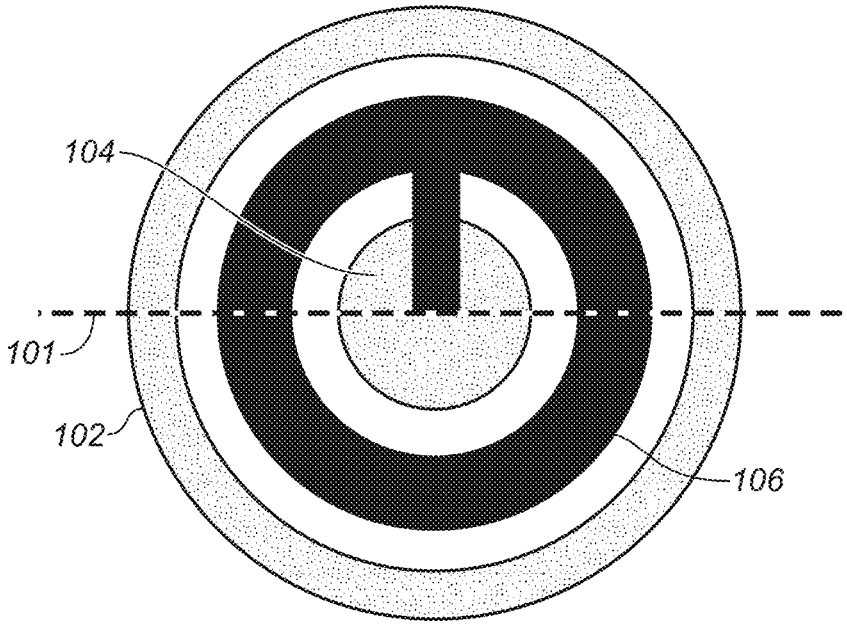
FIG. 5 is a top view of an example PMUT device having a circular shape, according to some embodiments.

FIG. 5 is a top view of another example of the PMUT device 100 of FIG. 1 having a substantially circular shape, which corresponds in part to a cross section along dotted line 101 in FIG. 5. Layout of surrounding edge support 102, interior support 104, and lower electrode 106 are illustrated, with other continuous layers not shown. It should be appreciated that the term "substantially" in "substantially circular shape" is intended to convey that a PMUT device 100 is generally circle-shaped, with allowances for variations due to manufacturing processes and tolerances, and that slight deviation from a circle shape (e.g., slight deviations on radial distance from center, etc.) may be present in a manufactured device.

Figure 6:
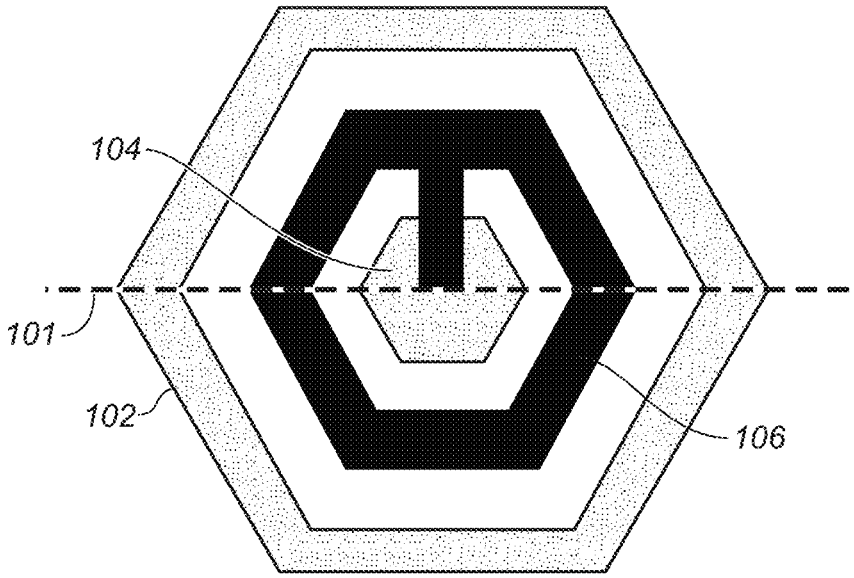
FIG. 6 is a top view of an example PMUT device having a hexagonal shape, according to some embodiments.

FIG. 6 is a top view of another example of the PMUT device 100 of FIG. 1 having a substantially hexagonal shape, which corresponds in part to a cross section along dotted line 101 in FIG. 6. Layout of surrounding edge support 102, interior support 104, and lower electrode 106 are illustrated, with other continuous layers not shown. It should be appreciated that the term "substantially" in "substantially hexagonal shape" is intended to convey that a PMUT device 100 is generally hexagon-shaped, with allowances for variations due to manufacturing processes and tolerances, and that slight deviation from a hexagon shape (e.g., rounded corners, slightly wavering lines, deviations from perfectly orthogonal corners or intersections, etc.) may be present in a manufactured device.

Figure 7:
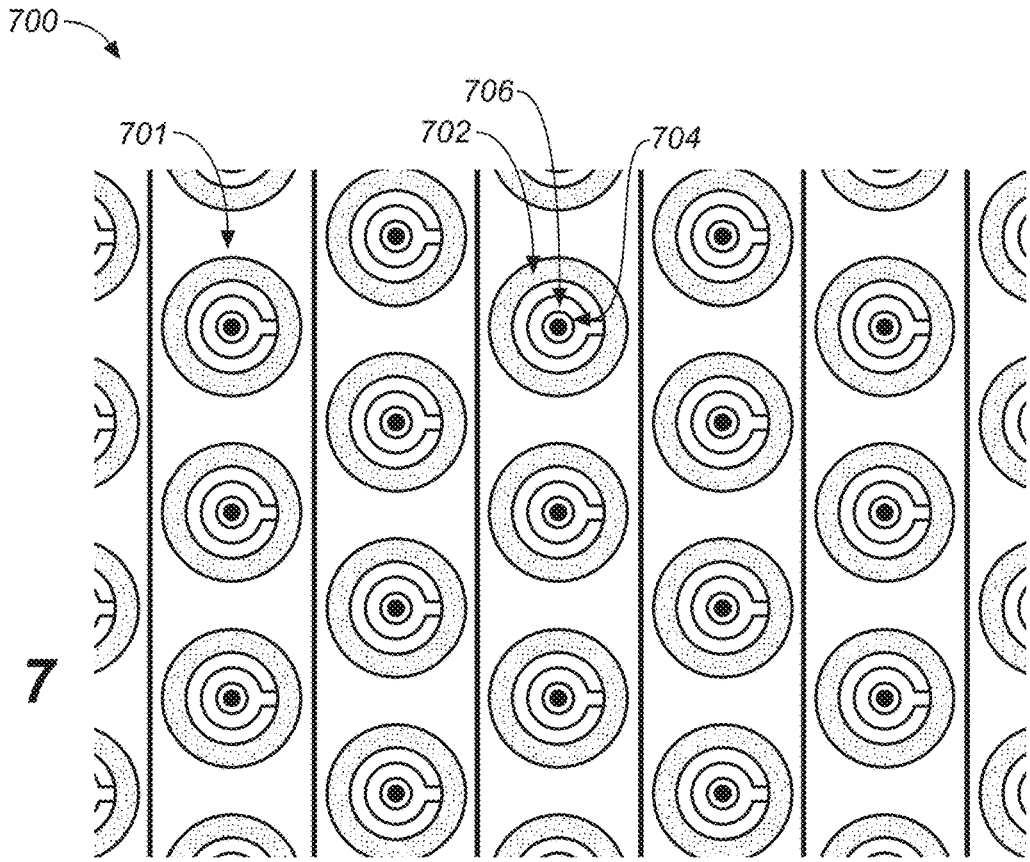
FIG. 7 illustrates an example array of circular-shaped PMUT devices, according to some embodiments.

FIG. 7 illustrates an example two-dimensional array 700 of circular-shaped PMUT devices 701 formed from PMUT devices having a substantially circular shape similar to that discussed in conjunction with FIGS. 1, 2 and 5. Layout of circular surrounding edge support 702, interior support 704, and annular or ring shaped lower electrode 706 surrounding the interior support 704 are illustrated, while other continuous layers are not shown for clarity. As illustrated, array 700 includes columns of circular-shaped PMUT devices 701 that are offset. It should be appreciated that the circular-shaped PMUT devices 701 may be closer together, such that edges of the columns of circular-shaped PMUT devices 701 overlap. Moreover, it should be appreciated that circular-shaped PMUT devices 701 may contact each other. In various embodiments, adjacent circular-shaped PMUT devices 701 are electrically isolated. In other embodiments, groups of adjacent circular-shaped PMUT devices 701 are electrically connected, where the groups of adjacent circular-shaped PMUT devices 701 are electrically isolated.

Figure 8:
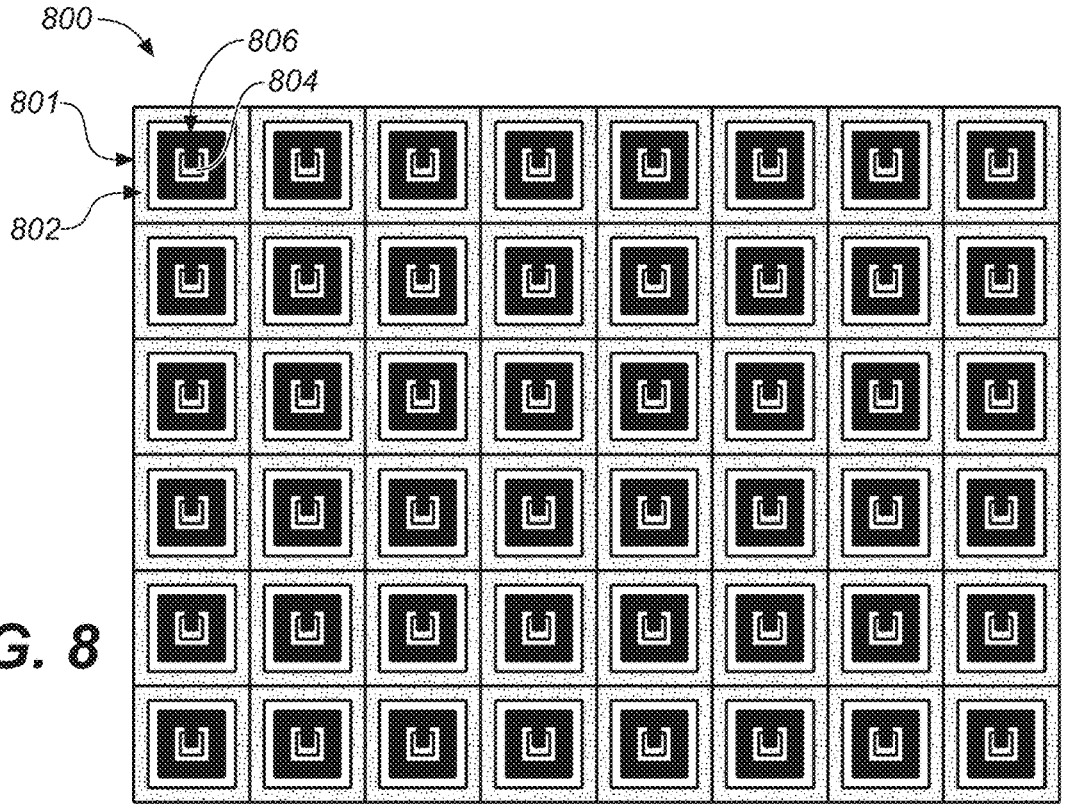
FIG. 8 illustrates an example array of square-shaped PMUT devices, according to some embodiments.

FIG. 8 illustrates an example two-dimensional array 800 of square-shaped PMUT devices 801 formed from PMUT devices having a substantially square shape similar to that discussed in conjunction with FIGS. 1, 2 and 3. Layout of square surrounding edge support 802, interior support 804, and square-shaped lower electrode 806 surrounding the interior support 804 are illustrated, while other continuous layers are not shown for clarity. As illustrated, array 800 includes columns of square-shaped PMUT devices 801 that are in rows and columns. It should be appreciated that rows or columns of the square-shaped PMUT devices 801 may be offset. Moreover, it should be appreciated that square-shaped PMUT devices 801 may contact each other or be spaced apart. In various embodiments, adjacent square-shaped PMUT devices 801 are electrically isolated. In other embodiments, groups of adjacent square-shaped PMUT devices 801 are electrically connected, where the groups of adjacent square-shaped PMUT devices 801 are electrically isolated.

Figure 9:
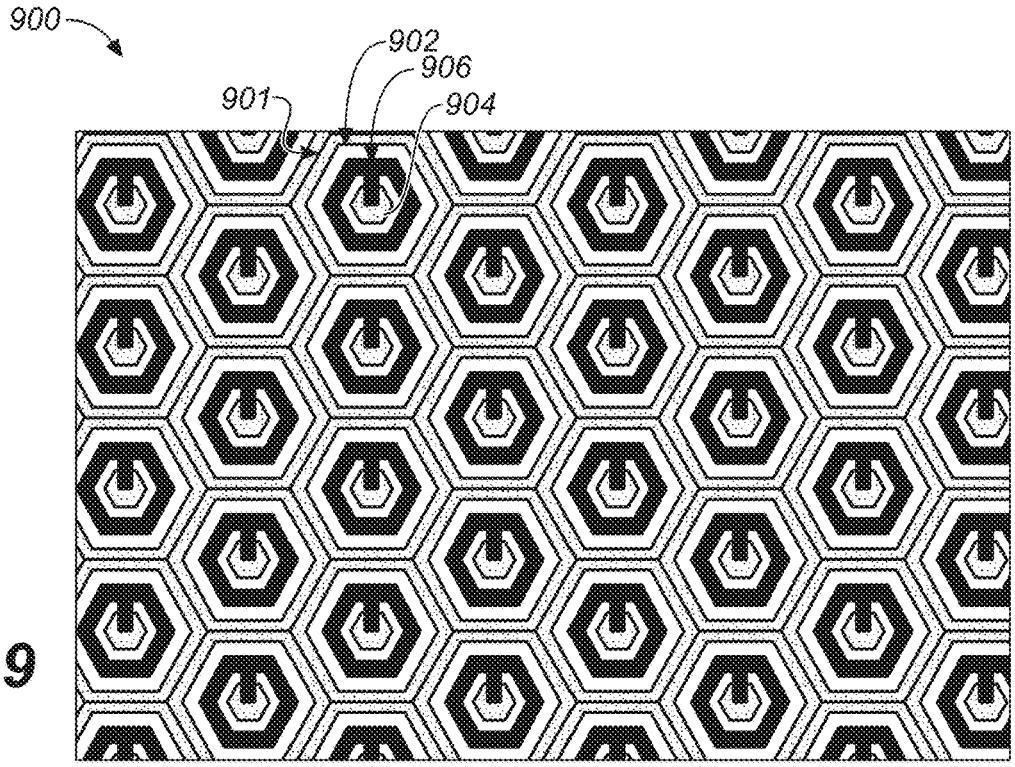
FIG. 9 illustrates an example array of hexagonal-shaped PMUT devices, according to some embodiments.

FIG. 9 illustrates an example two-dimensional array 900 of hexagon-shaped PMUT devices 901 formed from PMUT devices having a substantially hexagon shape similar to that discussed in conjunction with FIGS. 1, 2 and 6. Layout of hexagon-shaped surrounding edge support 902, interior support 904, and hexagon-shaped lower electrode 906 surrounding the interior support 904 are illustrated, while other continuous layers are not shown for clarity. It should be appreciated that rows or columns of the hexagon-shaped PMUT devices 901 may be offset. Moreover, it should be appreciated that hexagon-shaped PMUT devices 901 may contact each other or be spaced apart. In various embodiments, adjacent hexagon-shaped PMUT devices 901 are electrically isolated. In other embodiments, groups of adjacent hexagon-shaped PMUT devices 901 are electrically connected, where the groups of adjacent hexagon-shaped PMUT devices 901 are electrically isolated. While FIGS. 7, 8 and 9 illustrate example layouts of PMUT devices having different shapes, it should be appreciated that many different layouts are available. Moreover, in accordance with various embodiments, arrays of PMUT devices are included within a MEMS layer.

In operation, during transmission, selected sets of PMUT devices in the two-dimensional array can transmit an acoustic signal (e.g., a short ultrasonic pulse) and during sensing, the set of active PMUT devices in the two-dimensional array can detect an interference of the acoustic signal with an object (in the path of the acoustic wave). The received interference signal (e.g., generated based on reflections, echoes, etc. of the acoustic signal from the object) can then be analyzed. As an example, an image of the object, a distance of the object from the sensing component, a density of the object, a motion of the object, etc., can all be determined based on comparing a frequency and/or phase of the interference signal with a frequency and/or phase of the acoustic signal. Moreover, results generated can be further analyzed or presented to a user via a display device (not shown).

FIG. 10 illustrates a pair of example PMUT devices 1000 in a PMUT array, with each PMUT sharing at least one common edge support 1002. As illustrated, the PMUT devices have two sets of independent lower electrode labeled as 1006 and 1026. These differing electrode patterns enable antiphase operation of the PMUT devices 1000, and increase flexibility of device operation. In one embodiment, the pair of PMUTs may be identical, but the two electrodes could drive different parts of the same PMUT antiphase (one contracting, and one extending), such that the PMUT displacement becomes larger. While other continuous layers are not shown for clarity, each PMUT also includes an upper electrode (e.g., upper electrode 108 of FIG. 1). Accordingly, in various embodiments, a PMUT device may include at least three electrodes.

FIGS. 11A, 11B, 11C, and 11D illustrate alternative examples of interior support structures, in accordance with various embodiments. Interior supports structures may also be referred to as "pinning structures," as they operate to pin the membrane to the substrate. It should be appreciated that interior support structures may be positioned anywhere within a cavity of a PMUT device, and may have any type of shape (or variety of shapes), and that there may be more than one interior support structure within a PMUT device. While FIGS. 11A, 11B, 11C, and 11D illustrate alternative examples of interior support structures, it should be appreciated that these examples are for illustrative purposes, and are not intended to limit the number, position, or type of interior support structures of PMUT devices.

Figure 11A:
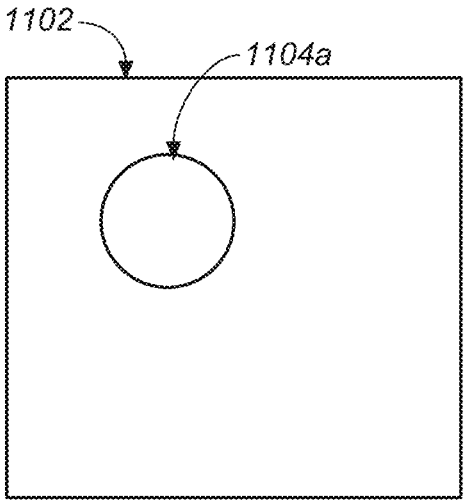
FIGS. 11A, 11B, 11C, and 11D illustrate alternative examples of interior support structures, according to various embodiments.
Figure 11B:
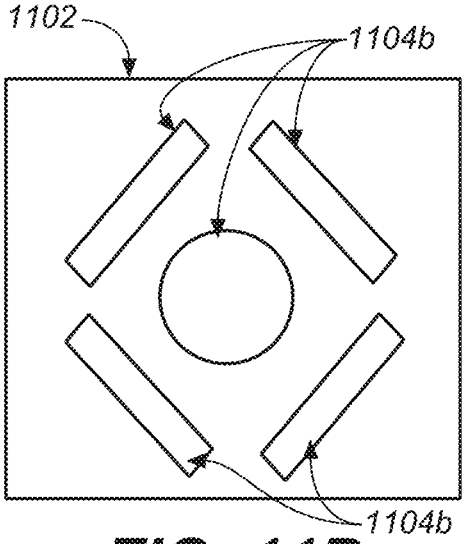
Figure 11C:
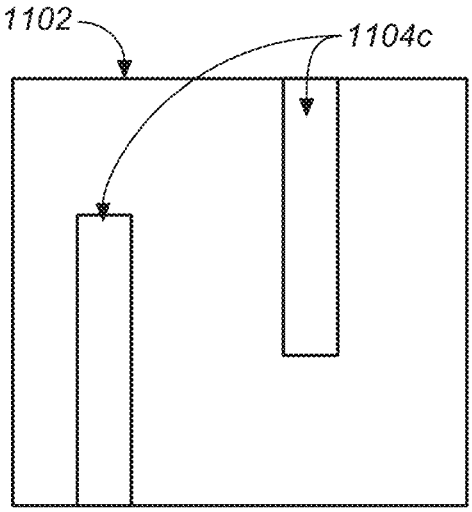
Figure 11D:
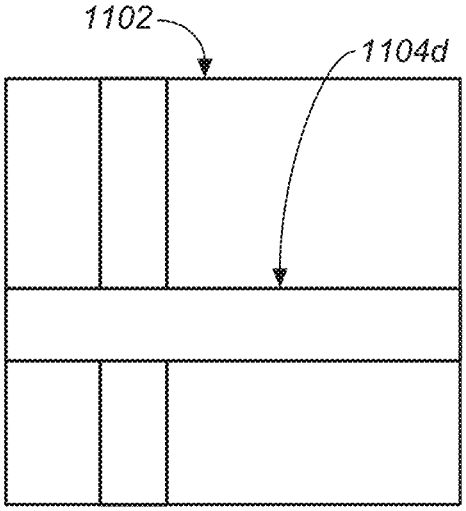

For example, interior supports structures do not have to be centrally located with a PMUT device area, but can be non-centrally positioned within the cavity. As illustrated in FIG. 11A, interior support 1104*a* is positioned in a non-central, off-axis position with respect to edge support 1102. In other embodiments such as seen in FIG. 11B, multiple interior supports 1104*b* can be used. In this embodiment, one interior support is centrally located with respect to edge support 1102, while the multiple, differently shaped and sized interior supports surround the centrally located support. In still other embodiments, such as seen with respect to FIGS. 11C and 11D, the interior supports (respectively 1104*c* and 1104*d*) can contact a common edge support 1102. In the embodiment illustrated in FIG. 11D, the interior supports 1104*d* can effectively divide the PMUT device into subpixels. This would allow, for example, activation of smaller areas to generate high frequency ultrasonic waves, and sensing a returning ultrasonic echo with larger areas of the PMUT device. It will be appreciated that the individual pinning structures can be combined into arrays.

Figure 12:
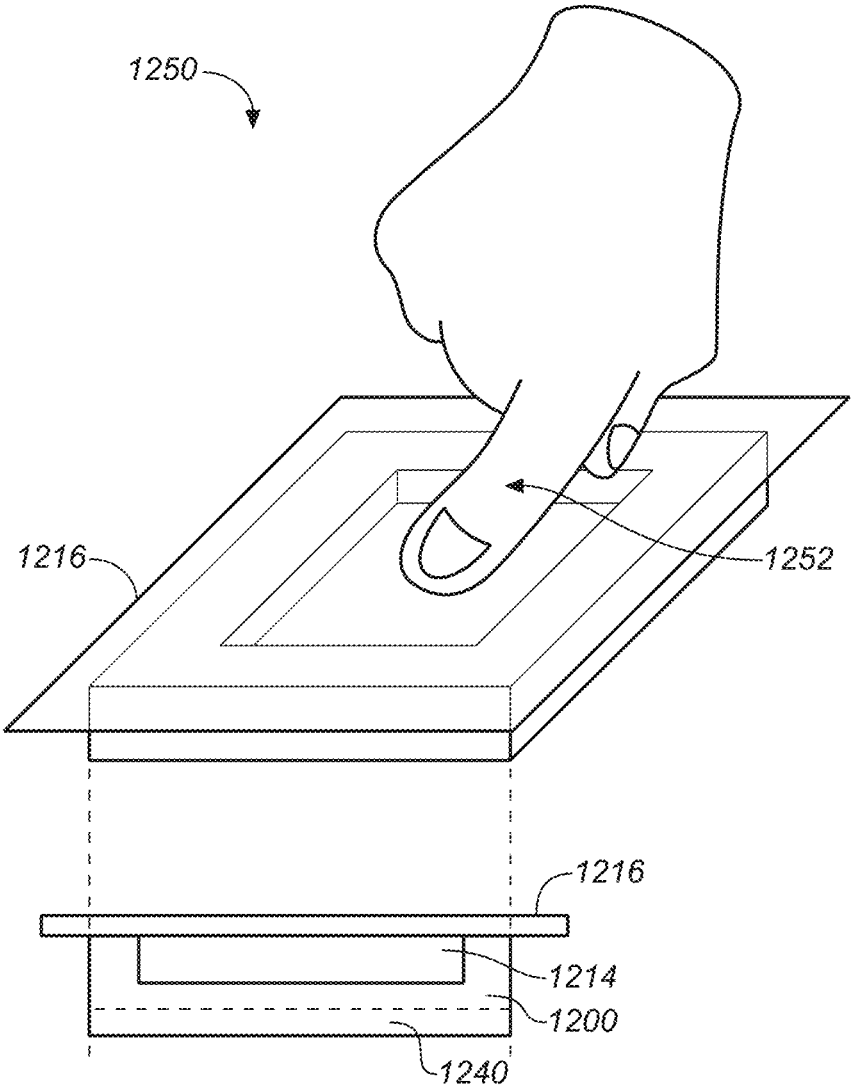
FIG. 12 illustrates a PMUT array used in an ultrasonic fingerprint sensing system, according to some embodiments.

FIG. 12 illustrates an embodiment of a PMUT array used in an ultrasonic fingerprint sensing system 1250. The fingerprint sensing system 1250 can include a platen 1216 onto which a human finger 1252 may make contact. Ultrasonic signals are generated and received by a PMUT device array 1200, and travel back and forth through acoustic coupling layer 1214 and platen 1216. Signal analysis is conducted using processing logic module 1240 (e.g., control logic) directly attached (via wafer bonding or other suitable techniques) to the PMUT device array 1200. It will be appreciated that the size of platen 1216 and the other elements illustrated in FIG. 12 may be much larger (e.g., the size of a handprint) or much smaller (e.g., just a fingertip) than as shown in the illustration, depending on the particular application.

In this example for fingerprinting applications, the human finger 1252 and the processing logic module 1240 can determine, based on a difference in interference of the acoustic signal with valleys and/or ridges of the skin on the finger, an image depicting epi-dermis and/or dermis layers of the finger. Further, the processing logic module 1240 can compare the image with a set of known fingerprint images to facilitate identification and/or authentication. Moreover, in one example, if a match (or substantial match) is found, the identity of user can be verified. In another example, if a match (or substantial match) is found, a command/operation can be performed based on an authorization rights assigned to the identified user. In yet another example, the identified user can be granted access to a physical location and/or network/computer resources (e.g., documents, files, applications, etc.)

In another example, for finger-based applications, the movement of the finger can be used for cursor tracking/movement applications. In such embodiments, a pointer or cursor on a display screen can be moved in response to finger movement. It is noted that processing logic module 1240 can include or be connected to one or more processors configured to confer at least in part the functionality of system 1250. To that end, the one or more processors can execute code instructions stored in memory, for example, volatile memory and/or nonvolatile memory.

Figure 13:
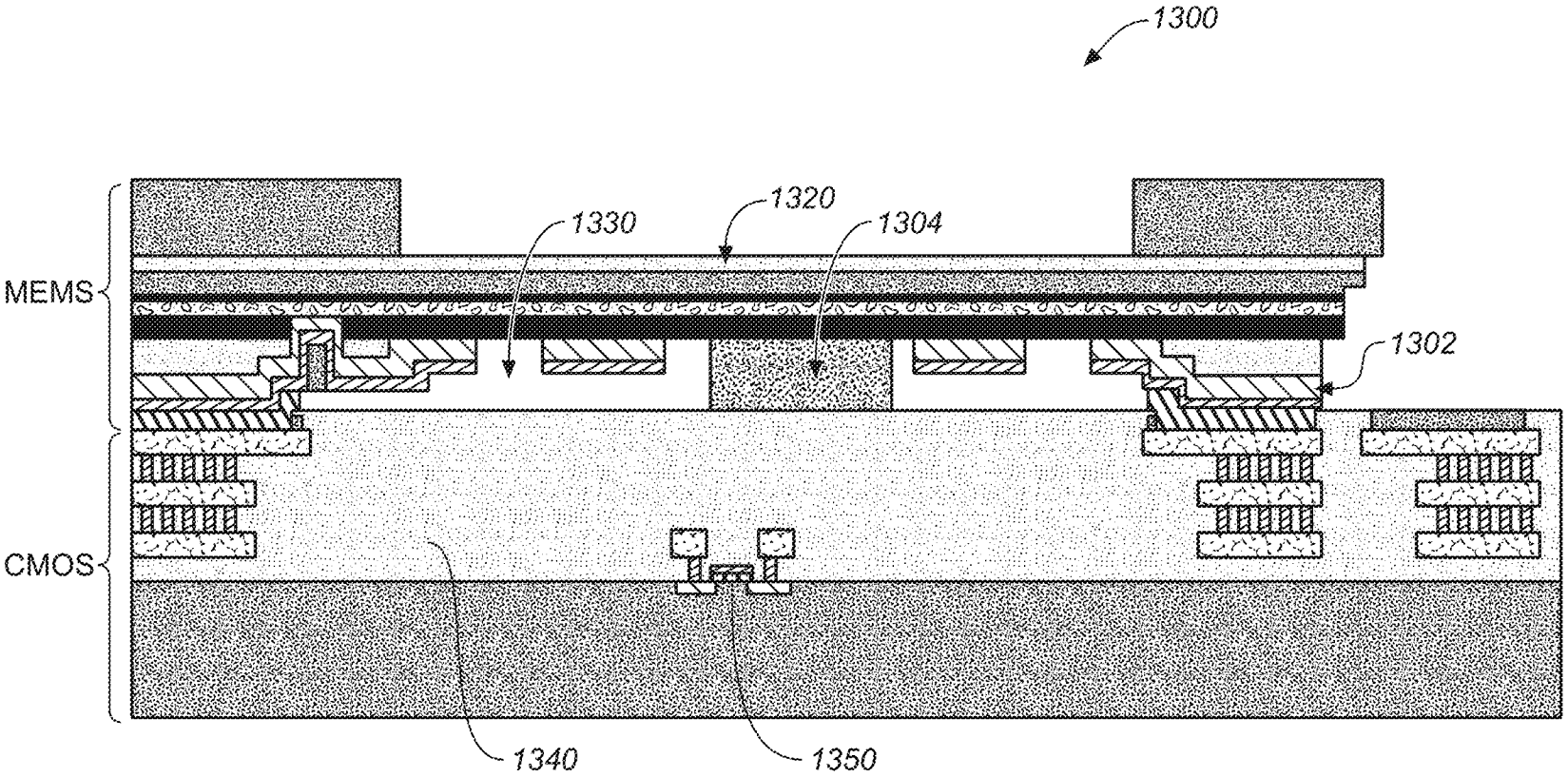
FIG. 13 illustrates an integrated fingerprint sensor formed by wafer bonding a CMOS logic wafer and a microelectromechanical (MEMS) wafer defining PMUT devices, according to some embodiments.

FIG. 13 illustrates an integrated fingerprint sensor 1300 formed by wafer bonding a CMOS logic wafer and a MEMS wafer defining PMUT devices, according to some embodiments. FIG. 13 illustrates in partial cross section one embodiment of an integrated fingerprint sensor formed by wafer bonding a substrate 1340 CMOS logic wafer and a MEMS wafer defining PMUT devices having a common edge support 1302 and separate interior support 1304. For example, the MEMS wafer may be bonded to the CMOS logic wafer using aluminum and germanium eutectic alloys, as described in U.S. Pat. No. 7,442,570. PMUT device 1300 has an interior pinned membrane 1320 formed over a cavity 1330. The membrane 1320 is attached both to a surrounding edge support 1302 and interior support 1304. The membrane 1320 is formed from multiple layers. In one embodiment, integrated fingerprint sensor 1300 includes temperature sensor 1350 in the CMOS logic wafer. In one embodiment, the CMOS logic wafer includes at least one drive circuit for driving transmission of ultrasonic signals from ultrasonic transducers of the array of ultrasonic transducers and at least one receive circuit for receiving reflected ultrasonic signals from ultrasonic transducers of the array of ultrasonic transducers.

Example Ultrasonic Transducer with a Non-Uniform Membrane

Devices and methods disclosed herein provide an ultrasonic transducer (e.g., a PMUT) having a non-uniform membrane. One or more embodiments are now described with reference to the drawings, wherein like reference numerals are used to refer to like elements throughout. In the following description, for purposes of explanation, numerous specific details are set forth in order to provide a thorough understanding of the various embodiments. It may be evident, however, that the various embodiments can be practiced without these specific details. In other instances, well-known structures and devices are shown in block diagram form in order to facilitate describing the embodiments in additional detail.

Figure 14:
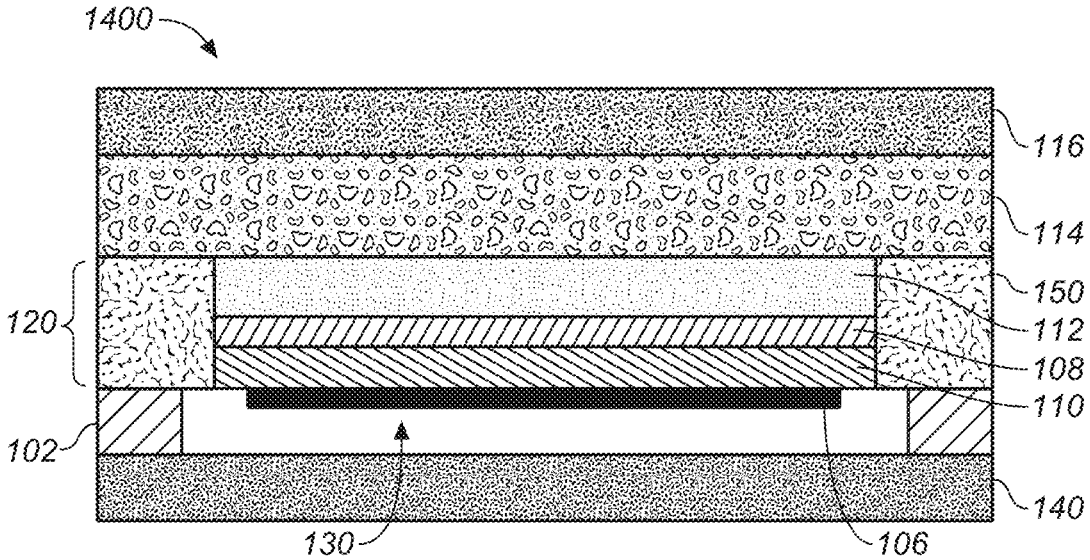
FIG. 14 is a diagram illustrating a PMUT device including a compliant anchor, according to some embodiments.

FIG. 14 is a diagram illustrating a PMUT device 1400 including a compliant anchor 150, according to some embodiments. PMUT device 1400 includes similar components to and operates in a similar manner as PMUT device 100 of FIG. 1, with the exception of PMUT device 1400 including a compliant anchor 150 and not including an interior support. Membrane 120 is attached to a surrounding edge support 102 via compliant anchor 150. In one embodiment, edge support 102 is connected to an electric potential. Edge support 102 may be made of electrically conducting materials, such as and without limitation, aluminum, molybdenum, or titanium. Edge support 102 may also be made of dielectric materials, such as silicon dioxide, silicon nitride or aluminum oxide that have electrical connections on the sides or in vias through edge support 102, electrically coupling lower electrode 106 to electrical wiring in substrate 140.

In one embodiment, edge support 102 is attached to a substrate 140. In various embodiments, substrate 140 may include at least one of, and without limitation, silicon or silicon nitride. It should be appreciated that substrate 140 may include electrical wirings and connection, such as aluminum or copper. In one embodiment, substrate 140 includes a CMOS logic wafer bonded to edge support 102. In one embodiment, the membrane 120 comprises multiple layers. In an example embodiment, the membrane 120 includes lower electrode 106, piezoelectric layer 110, and upper electrode 108, where lower electrode 106 and upper electrode 108 are coupled to opposing sides of piezoelectric layer 110. As shown, lower electrode 106 is coupled to a lower surface of piezoelectric layer 110 and upper electrode 108 is coupled to an upper surface of piezoelectric layer 110. It should be appreciated that, in various embodiments, PMUT device 1400 is a microelectromechanical (MEMS) device.

In one embodiment, membrane 120 also includes a mechanical support layer 112 (e.g., stiffening layer) to mechanically stiffen the layers. In various embodiments, mechanical support layer 112 may include at least one of, and without limitation, silicon, silicon oxide, silicon nitride, aluminum, molybdenum, titanium, etc. In some embodiments, membrane 120 is a non-uniform membrane having non-uniform stiffness to provide for non-uniform movement of membrane 120.

In one embodiment, PMUT device 1400 also includes an acoustic coupling layer 114 above membrane 120 for supporting transmission of acoustic signals. It should be appreciated that acoustic coupling layer can include air, liquid, gel-like materials, epoxy, or other materials for supporting transmission of acoustic signals. In one embodiment, PMUT device 1400 also includes platen layer 116 above acoustic coupling layer 114 for containing acoustic coupling layer 114 and providing a contact surface for a finger or other sensed object with PMUT device 1400. It should be appreciated that, in various embodiments, acoustic coupling layer 114 provides a contact surface, such that platen layer 116 is optional. Moreover, it should be appreciated that acoustic coupling layer 114 and/or platen layer 116 may be included with or used in conjunction with multiple PMUT devices 1400. For example, an array of PMUT devices 1400 may be coupled with a single acoustic coupling layer 114 and/or platen layer 116.

PMUT device 1400 includes compliant anchor 150 coupled to membrane 120 and edge support 102. In accordance with various embodiments, compliant anchor 150 has stiffness different than the stiffness of membrane 120. In one embodiment, the stiffness of compliant anchor 150 is less than the stiffness of membrane 120. In another embodiment, the stiffness of compliant anchor 150 is greater than the stiffness of membrane 120. In one embodiment, compliant anchor 150 extends out from edge support 102 and over substrate 140, such that a bottom surface of compliant anchor 150 extends into cavity 130. It should be appreciated that the difference in stiffness between membrane 120 and compliant anchor 150 may be due to a different material makeup, a different thickness, voids in one of the membrane 120 and compliant anchor 150 reducing the amount of material, or any combination thereof. In effect, use of the compliant anchor 150 allows for control of the volumetric displacement of membrane 120 with respect to cavity 130. For example, where compliant anchor 150 has a stiffness less than the stiffness of membrane 120, compliant anchor 150 allows for greater volumetric displacement of the membrane 120 with respect to cavity 130 than would be provided by a continuous, uniform membrane.

In general, stiffness of a membrane is proportional to the Young's modulus of the material comprising the membrane and the cross-sectional area of the membrane. Accordingly, to change the stiffness of the membrane, or a region of the membrane, a different material makeup can be introduced into the membrane or material can be removed from the membrane. In one embodiment, the material(s) of compliant anchor 150 has a Young's modulus that is much than the Young's modulus of materials comprising the membrane 120. Some polymers, including epoxies can be used to form compliant anchor 150.

Figure 15:
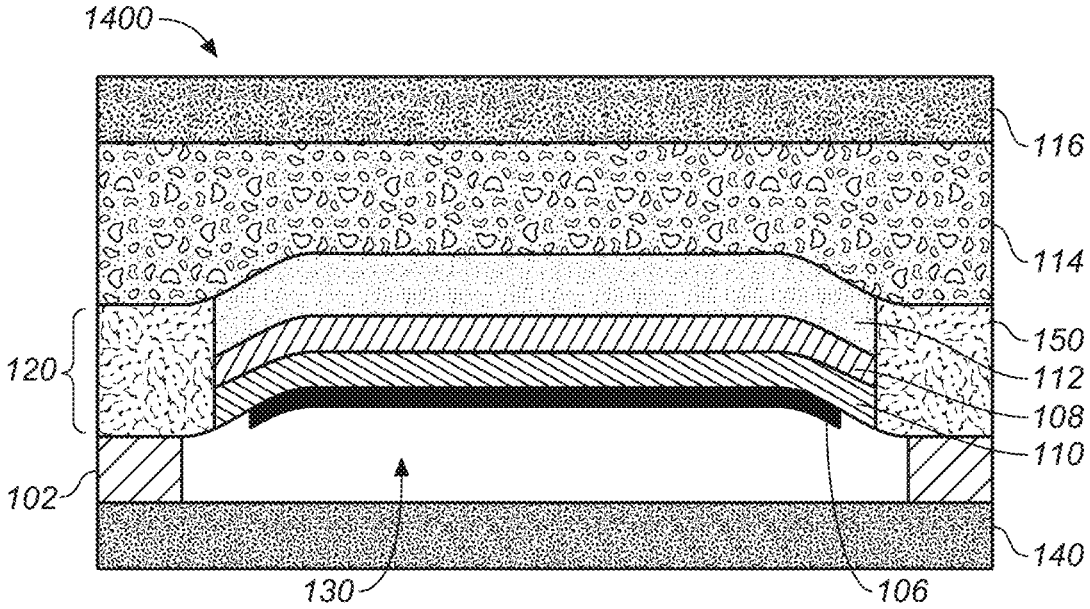
FIG. 15 is a diagram illustrating an example of membrane movement during activation of a PMUT device including a compliant anchor, according to some embodiments.

FIG. 15 is a diagram illustrating an example of membrane movement during activation of PMUT device 1400, according to some embodiments. As illustrated with respect to FIG. 15, in operation, responsive to an object proximate platen layer 116, the electrodes 106 and 108 deliver a high frequency electric charge to the piezoelectric layer 110, causing those portions of the membrane 120 not pinned to the surrounding edge support 102 via compliant anchor 150 and portion of compliant anchor 150 extending over cavity 130 to be displaced upward into the acoustic coupling layer 114. This generates a pressure wave that can be used for signal probing of the object. Return echoes can be detected as pressure waves causing movement of the membrane, with compression of the piezoelectric material in the membrane causing an electrical signal proportional to amplitude of the pressure wave.

The described PMUT device 1400 can be used with almost any electrical device that converts a pressure wave into mechanical vibrations and/or electrical signals, as described above in accordance with FIGS. 1 and 2. Piezoelectric layer 110, electrodes 106 and 108, mechanical support layer 112, acoustic coupling material 114, and platen 116, operate in a similar manner as described in accordance with PMUT device 100 of FIGS. 1 and 2 above.

For example, when actuation voltage is applied to the electrodes, the membrane 120 and a portion of compliant anchor extending over cavity 130 will deform and move out of plane. The motion then pushes the acoustic coupling layer 114 it is in contact with and an acoustic (ultrasonic) wave is generated. Oftentimes, vacuum is present inside the cavity 130 and therefore damping contributed from the media within the cavity 130 can be ignored. However, the acoustic coupling layer 114 on the other side of the membrane 120 can substantially change the damping of the PMUT device 1400. For example, a quality factor greater than 20 can be observed when the PMUT device 1400 is operating in air with atmosphere pressure (e.g., acoustic coupling layer 114 is air) and can decrease lower than 2 if the PMUT device 1400 is operating in water (e.g., acoustic coupling layer 114 is water).

Figure 16:
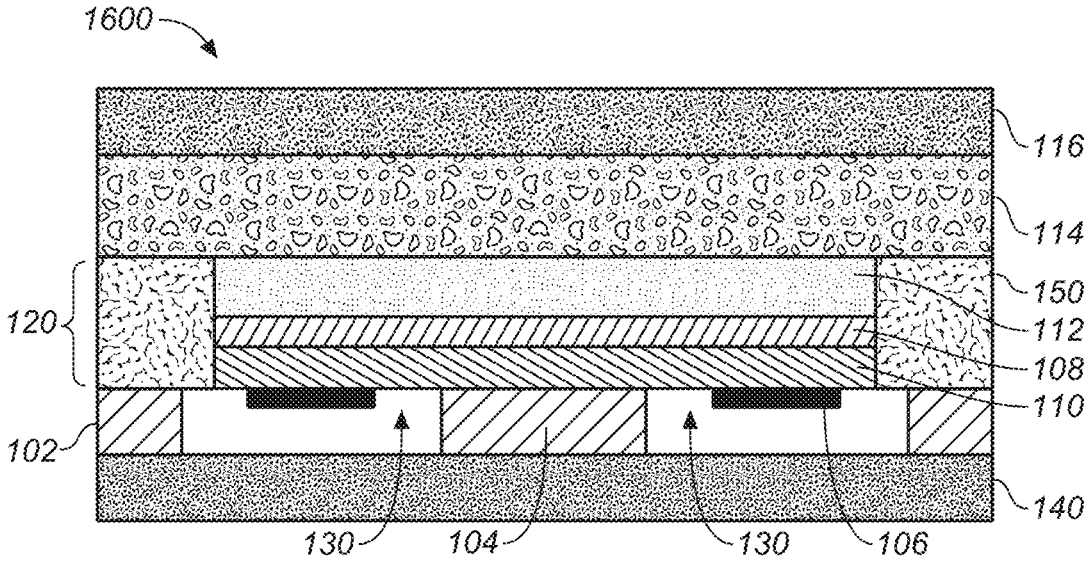
FIG. 16 is a diagram illustrating a PMUT device including an interior support structure and a compliant anchor, according to some embodiments.

FIG. 16 is a diagram illustrating a PMUT device 1600 including a compliant anchor 150, according to some embodiments. PMUT device 1600 includes similar components to and operates in a similar manner as PMUT device 100 of FIG. 1 and PMUT device 1400 of FIG. 14. PMUT device 1600 includes an interior pinned membrane 120 positioned over a substrate 140 to define a cavity 130. In one embodiment, membrane 120 is attached both to a surrounding edge support 102 via compliant anchor 150 and interior support 104. In one embodiment, PMUT device 1600 also includes a compliant anchor (not pictured) for coupling membrane 120 to interior support 104. In one embodiment, edge support 102 is connected to an electric potential. Edge support 102 and interior support 104 may be made of electrically conducting materials, such as and without limitation, aluminum, molybdenum, or titanium. Edge support 102 and interior support 104 may also be made of dielectric materials, such as silicon dioxide, silicon nitride or aluminum oxide that have electrical connections on the sides or in vias through edge support 102 or interior support 104, electrically coupling lower electrode 106 to electrical wiring in substrate 140.

In one embodiment, both edge support 102 and interior support 104 are attached to a substrate 140. In various embodiments, substrate 140 may include at least one of, and without limitation, silicon or silicon nitride. It should be appreciated that substrate 140 may include electrical wirings and connection, such as aluminum or copper. In one embodiment, substrate 140 includes a CMOS logic wafer bonded to edge support 102 and interior support 104. In one embodiment, the membrane 120 comprises multiple layers. In an example embodiment, the membrane 120 includes lower electrode 106, piezoelectric layer 110, and upper electrode 108, where lower electrode 106 and upper electrode 108 are coupled to opposing sides of piezoelectric layer 110. As shown, lower electrode 106 is coupled to a lower surface of piezoelectric layer 110 and upper electrode 108 is coupled to an upper surface of piezoelectric layer 110. It should be appreciated that, in various embodiments, PMUT device 1600 is a microelectromechanical (MEMS) device.

In one embodiment, membrane 120 also includes a mechanical support layer 112 (e.g., stiffening layer) to mechanically stiffen the layers. In various embodiments, mechanical support layer 112 may include at least one of, and without limitation, silicon, silicon oxide, silicon nitride, aluminum, molybdenum, titanium, etc. In some embodiments, membrane 120 is a non-uniform membrane having non-uniform stiffness to provide for non-uniform movement of membrane 120.

In one embodiment, PMUT device 1600 also includes an acoustic coupling layer 114 above membrane 120 for supporting transmission of acoustic signals. It should be appreciated that acoustic coupling layer can include air, liquid, gel-like materials, epoxy, or other materials for supporting transmission of acoustic signals. In one embodiment, PMUT device 1600 also includes platen layer 116 above acoustic coupling layer 114 for containing acoustic coupling layer 114 and providing a contact surface for a finger or other sensed object with PMUT device 1600. It should be appreciated that, in various embodiments, acoustic coupling layer 114 provides a contact surface, such that platen layer 116 is optional. Moreover, it should be appreciated that acoustic coupling layer 114 and/or platen layer 116 may be included with or used in conjunction with multiple PMUT devices 1600. For example, an array of PMUT devices 1600 may be coupled with a single acoustic coupling layer 114 and/or platen layer 116.

PMUT device 1600 includes compliant anchor 150 coupled to membrane 120 and edge support 102. In accordance with various embodiments, compliant anchor 150 has stiffness different than the stiffness of membrane 120. In one embodiment, the stiffness of compliant anchor 150 is less than the stiffness of membrane 120. In another embodiment, the stiffness of compliant anchor 150 is greater than the stiffness of membrane 120. In one embodiment, compliant anchor 150 extends out from edge support 102 and over substrate 140, such that a bottom surface of compliant anchor 150 extends into cavity 130. It should be appreciated that the difference in stiffness between membrane 120 and compliant anchor 150 may be due to a different material makeup, a different thickness, voids in one of the membrane 120 and compliant anchor 150 reducing the amount of material, or any combination thereof. In effect, use of the compliant anchor 150 allows for control of the volumetric displacement of membrane 120 with respect to cavity 130. For example, where compliant anchor 150 has a stiffness less than the stiffness of membrane 120, compliant anchor 150 allows for greater volumetric displacement of the membrane 120 with respect to cavity 130 than would be provided by a continuous, uniform membrane. In one embodiment, the material(s) of compliant anchor 150 has a Young's modulus that is much than the Young's modulus of materials comprising the membrane 120. Some polymers, including epoxies can be used to form compliant anchor 150.

Figure 17:
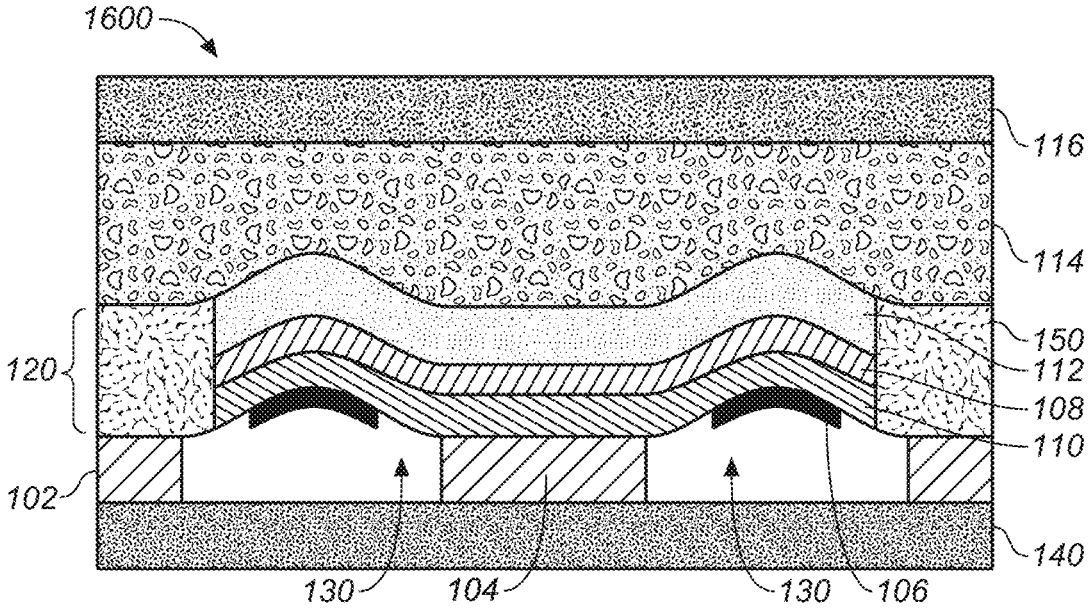
FIG. 17 is a diagram illustrating an example of membrane movement during activation of a PMUT device including an interior support structure and a compliant anchor, according to some embodiments.

FIG. 17 is a diagram illustrating an example of membrane movement during activation of PMUT device 1600, according to some embodiments. As illustrated with respect to FIG. 17, in operation, responsive to an object proximate platen layer 116, the electrodes 106 and 108 deliver a high frequency electric charge to the piezoelectric layer 110, causing those portions of the membrane 120 and not pinned to the surrounding edge support 102 via compliant anchor 150 or interior support 104 and a portion of compliant anchor 150 extending over cavity 130 to be displaced upward into the acoustic coupling layer 114. This generates a pressure wave that can be used for signal probing of the object. Return echoes can be detected as pressure waves causing movement of the membrane, with compression of the piezoelectric material in the membrane causing an electrical signal proportional to amplitude of the pressure wave.

The described PMUT device 1400 can be used with almost any electrical device that converts a pressure wave into mechanical vibrations and/or electrical signals, as described above in accordance with FIGS. 1 and 2. Piezoelectric layer 110, electrodes 106 and 108, mechanical support layer 112, acoustic coupling material 114, and platen 116, operate in a similar manner as described in accordance with PMUT device 100 of FIGS. 1 and 2 above.

For example, when actuation voltage is applied to the electrodes, the membrane 120 and a portion of compliant anchor extending over cavity 130 will deform and move out of plane. The motion then pushes the acoustic coupling layer 114 it is in contact with and an acoustic (ultrasonic) wave is generated. Oftentimes, vacuum is present inside the cavity 130 and therefore damping contributed from the media within the cavity 130 can be ignored. However, the acoustic coupling layer 114 on the other side of the membrane 120 can substantially change the damping of the PMUT device 1400. For example, a quality factor greater than 20 can be observed when the PMUT device 1400 is operating in air with atmosphere pressure (e.g., acoustic coupling layer 114 is air) and can decrease lower than 2 if the PMUT device 1400 is operating in water (e.g., acoustic coupling layer 114 is water).

FIGS. 18A-18F illustrate alternative examples of non-uniform membranes for use in an ultrasonic transducer (e.g., PMUT device 100 of FIG. 1, PMUT device 1400 of FIG. 14, or PMUT device 1600 of FIG. 16), according to some embodiments.

Figure 18A:
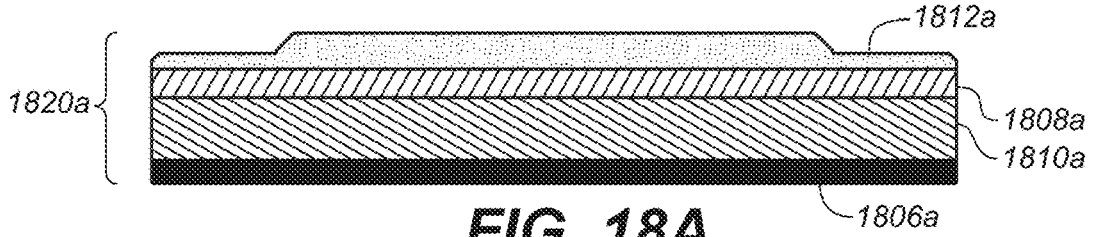
FIGS. 18A-18F illustrate alternative examples of non-uniform membranes for use in an ultrasonic transducer, according to some embodiments.

FIG. 18A is an alternative embodiment of a membrane 1820*a* suitable for use in a PMUT device (e.g., PMUT device 100 of FIG. 1, PMUT device 1400 of FIG. 14, or PMUT device 1600 of FIG. 16). The membrane 1820*a* is formed from multiple layers to have non-uniform mechanical and flexural properties. In this embodiment, the membrane 1820*a* includes a continuously extending lower electrode 1806*a*, piezoelectric layer 1810*a*, upper electrode 1808*a*, and a non-uniform stiffening layer 1812*a* to mechanically stiffen the membrane 1820*a*. The non-uniform stiffening layer 1812*a* is thinned along its peripheral region, the non-uniform stiffening layer 1812*a* having a thickness in the peripheral region less than the thickness of the interior region. The present embodiment provides greater membrane flexibility at the peripheral region and allows greater volumetric displacement of the membrane 1820*a* than would be provided by a continuous, uniform membrane having the thickness of the interior region.

Figure 18B:
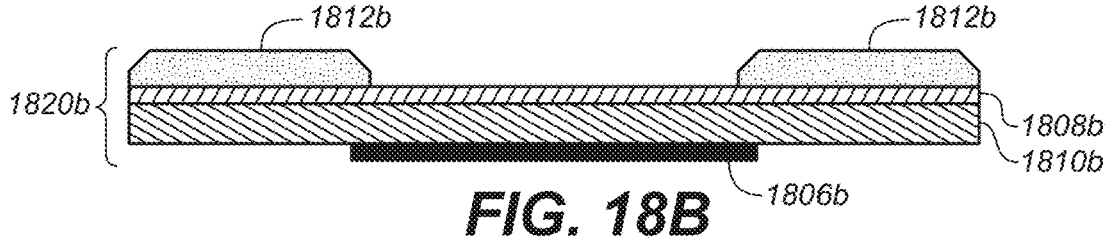

FIG. 18B is an alternative embodiment of a membrane 1820*b* suitable for use in a PMUT device (e.g., PMUT device 100 of FIG. 1, PMUT device 1400 of FIG. 14, or PMUT device 1600 of FIG. 16). The membrane 1820*b* is formed from multiple layers to have non-uniform mechanical and flexural properties. In this embodiment, the membrane 1820*b* includes a patterned lower electrode 1806*b*, piezoelectric layer 1810*b*, upper electrode 1808*b*, and a non-uniform stiffening layer 1812*b* to mechanically stiffen the membrane 1820*b*. The interior portion of non-uniform stiffening layer 1812*b* is removed. The present embodiment provides greater membrane flexibility and allows greater volumetric displacement of the interior region of membrane 1820*b* than the peripheral region.

Figure 18C:
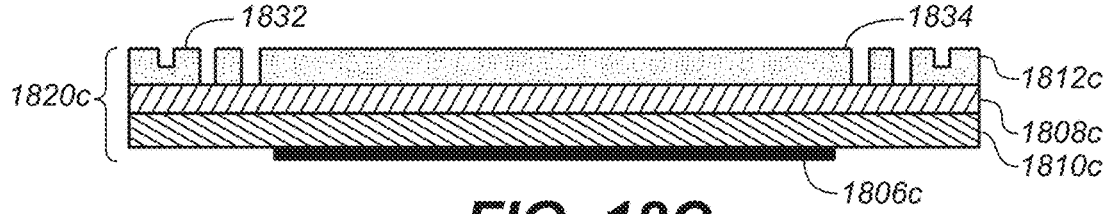

FIG. 18C is an alternative embodiment of a membrane 1820*c* suitable for use in a PMUT device (e.g., PMUT device 100 of FIG. 1, PMUT device 1400 of FIG. 14, or PMUT device 1600 of FIG. 16). The membrane 1820*c* is formed from multiple layers to have non-uniform mechanical and flexural properties. In this embodiment, the membrane 1820*c* includes a patterned lower electrode 1806*c*, piezoelectric layer 1810*c*, upper electrode 1808*c*, and a non-uniform stiffening layer 1812*c* to mechanically stiffen the membrane 1820*c*. The non-uniform stiffening layer 1812*c* includes voids 1832 and 1834 having no material in the peripheral region, thus reducing the stiffness of membrane 1820*c* at the peripheral region relative to the interior region. Voids (e.g., notches or trenches) may extend to any depth of membrane 1820*c*. As illustrated, voids 1832 extend into non-uniform stiffening layer 1812*c* (but not through) and voids 1834 extend through non-uniform stiffening layer 1812*c*. It should be appreciated that voids can extend through non-uniform stiffening layer 1812*c* and into or through piezoelectric layer 1810*c*, so long as upper electrode 1808*c* is electrically conductive (e.g., electrical conductively it maintained around the voids. It should be appreciated that where membrane 1820*c* is used in a PMUT device including an interior support, membrane 1820*c* may include voids in the region overlying the interior support (e.g., the interior support acts similar to an edge support). The present embodiment provides greater membrane flexibility at the peripheral region and allows greater volumetric displacement of the membrane 1820*c* than would be provided by a continuous, uniform membrane having the thickness and lack of voids of the interior region.

Figure 18D:
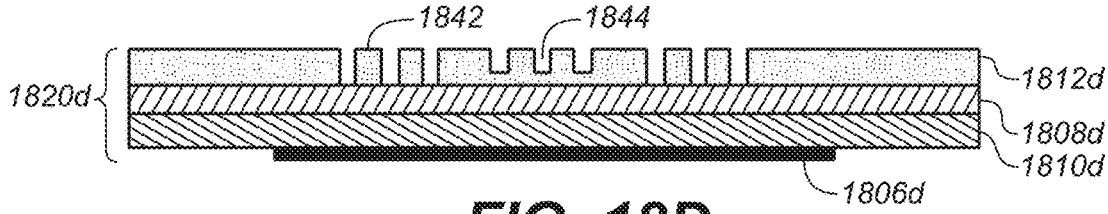

FIG. 18D is an alternative embodiment of a membrane 1820*d* suitable for use in a PMUT device (e.g., PMUT device 100 of FIG. 1, PMUT device 1400 of FIG. 14, or PMUT device 1600 of FIG. 16). The membrane 1820*d* is formed from multiple layers to have non-uniform mechanical and flexural properties. In this embodiment, the membrane 1820*d* includes a patterned lower electrode 1806*d*, piezoelectric layer 1810*d*, upper electrode 1808*d*, and a non-uniform stiffening layer 1812*d* to mechanically stiffen the membrane 1820*d*. The non-uniform stiffening layer 1812*d* includes at least one void 1842 having no material in the interior region, thus reducing the stiffness of membrane 1820*d* at the interior region relative to the interior region. Voids (e.g., notches or trenches) may extend to any depth of membrane 1820*d*. As illustrated, voids 1844 extend into non-uniform stiffening layer 1812*d* (but not through) and voids 1842 extend through non-uniform stiffening layer 1812*d*. It should be appreciated that voids can extend through non-uniform stiffening layer 1812*d* and into or through piezoelectric layer 1810*d*, so long as upper electrode 1808*d* is electrically conductive (e.g., electrical conductively it maintained around the voids. It should be appreciated that where membrane 1820*d* is used in a PMUT device including an interior support, membrane 1820*d* may not include voids in the region overlying the interior support (e.g., the interior support acts similar to an edge support). The present embodiment provides greater membrane flexibility at the interior region and allows greater volumetric displacement of the membrane 1820*d* than would be provided by a continuous, uniform membrane having the thickness and lack of voids of the peripheral region.

Figure 18E:
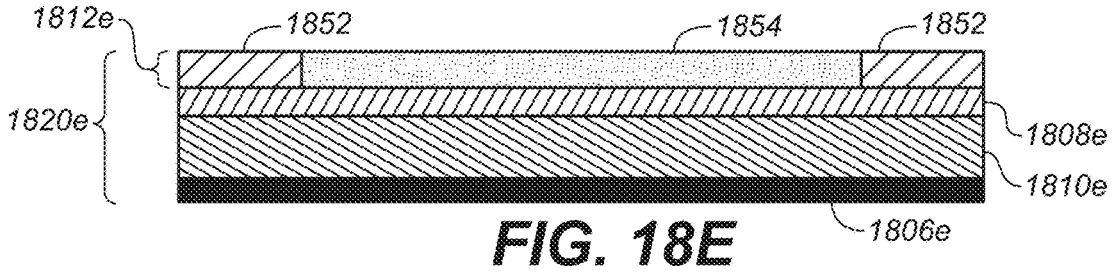

FIG. 18E is an alternative embodiment of a membrane 1820*e* suitable for use in a PMUT device (e.g., PMUT device 100 of FIG. 1, PMUT device 1400 of FIG. 14, or PMUT device 1600 of FIG. 16). The membrane 1820*e* is formed from multiple layers to have non-uniform mechanical and flexural properties. In this embodiment, the membrane 1820*e* includes a continuously extending lower electrode 1806*e*, piezoelectric layer 1810*e*, upper electrode 1808*e*, and a non-uniform stiffening layer 1812*e* to mechanically stiffen the membrane 1820*e*. The non-uniform stiffening layer 1812*e* includes material 1852 in the peripheral region and material 1854 in the interior region, wherein materials 1852 and 1854 are of different stiffness (e.g., have a different Young's modulus). In one embodiment, material 1852 has a stiffness greater than the stiffness of material 1854. In another embodiment, material 1854 has a stiffness greater than the stiffness of material 1852.

Figure 18F:
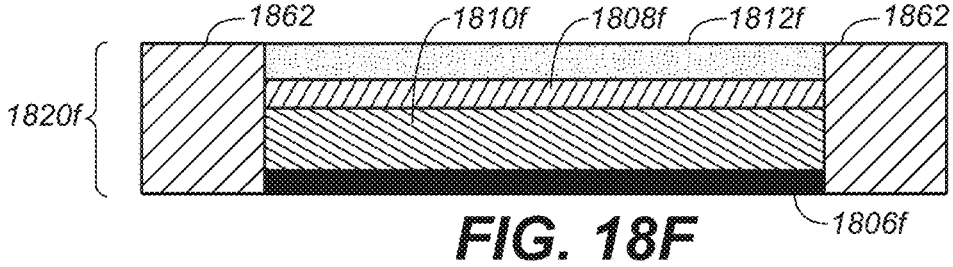

FIG. 18F is an alternative embodiment of a membrane 1820*f* suitable for use in a PMUT device (e.g., PMUT device 100 of FIG. 1, PMUT device 1400 of FIG. 14, or PMUT device 1600 of FIG. 16). The membrane 1820*f* is formed from multiple layers to have non-uniform mechanical and flexural properties. In this embodiment, the membrane 1820*f* includes a continuously extending lower electrode 1806*f*, piezoelectric layer 1810*f*, upper electrode 1808*f*, a uniform stiffening layer 1812*f* to mechanically stiffen the membrane 1820*e*, and a compliant anchor 1862. The stiffness of 1862 is different than the stiffness of the combined lower electrode 1806*f*, piezoelectric layer 1810*f*, upper electrode 1808*f*, and uniform stiffening layer 1812*f*.

Figure 19:
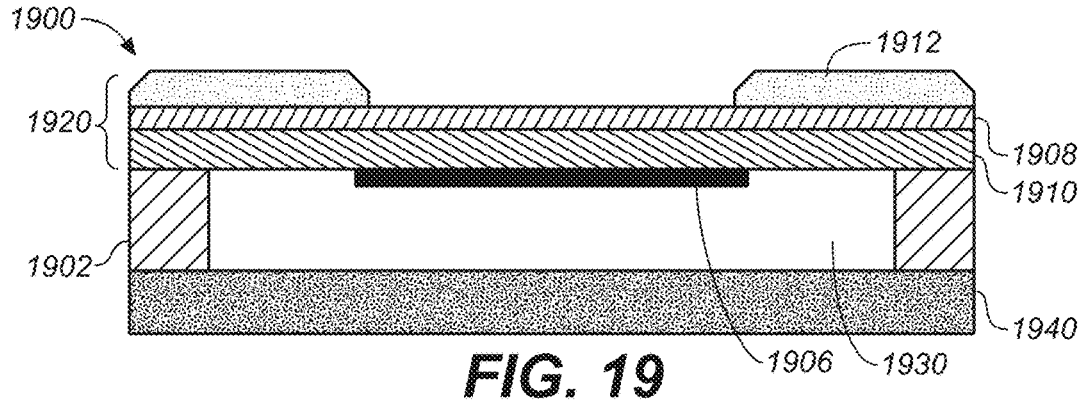
FIG. 19 is a diagram illustrating a PMUT device including a non-uniform membrane, according to some embodiments.

FIG. 19 is a diagram illustrating in cross section an embodiment of a PMUT device 1900 having a non-uniform membrane 1920 positioned over a substrate 1940 to define a cavity 1930. The membrane 1920 is attached to a surrounding edge support 1902. Edge support 1902 is attached to a substrate 1940. The membrane 1920 is formed from multiple layers to have non-uniform mechanical and flexural properties. In the present embodiment, the membrane 1920 includes lower electrode 1906, piezoelectric layer 1910, upper electrode 1908, and a partially extending stiffening layer 1912 to mechanically stiffen the membrane 1920, where the interior portion of non-uniform stiffening layer 1912 is removed. The non-uniform mechanical properties are provided in part by removal of a central portion of the stiffening layer 1912. Although not shown, it should be appreciated that non-uniform membrane 1920 could also be pinned using an interior support and that other variations of stiffening layer 1912 are possible.

Figure 20:
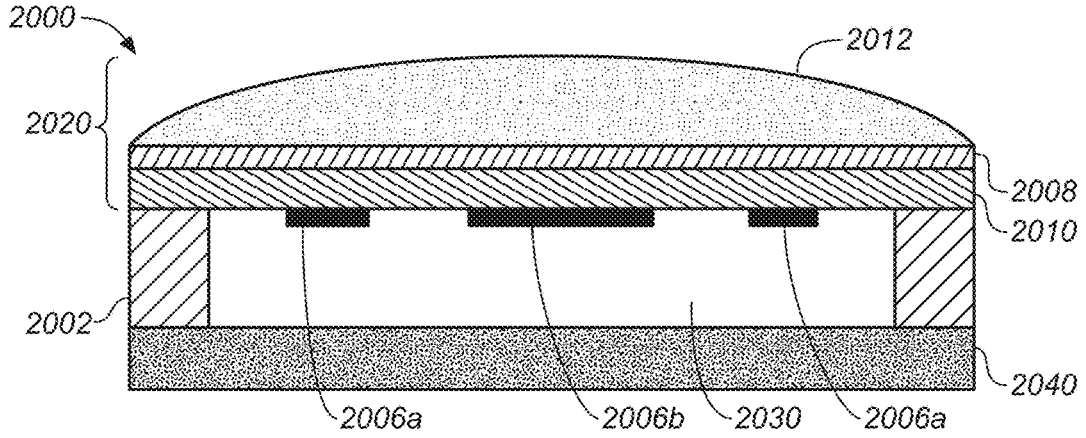
FIG. 20 is a diagram illustrating a PMUT device including a non-uniform membrane, according to some embodiments.

FIG. 20 is a diagram illustrating in cross section an embodiment of a PMUT device 2000 having a non-uniform membrane 2020 positioned over a substrate 2040 to define a cavity 2030. The membrane 2020 is attached to a surrounding edge support 2002. Edge support 2002 is attached to a substrate 2040. The membrane 2020 is formed from multiple layers to have non-uniform mechanical and flexural properties. In the present embodiment, the membrane 2020 includes multiple lower electrodes 2006*a* and 2006*b*, piezoelectric layer 2010, upper electrode 2008, and a curved stiffening layer 2012 to mechanically stiffen the membrane 2020. In the illustrated embodiment, multiple electrically independent bottom electrodes 2006*a* and 2006*b* can also be used to allow stimulation of various flexural modes. Although not shown, it should be appreciated that non-uniform membrane 2020 could also be pinned using an interior support and that other variations of stiffening layer 2012 are possible.

Figure 21A:
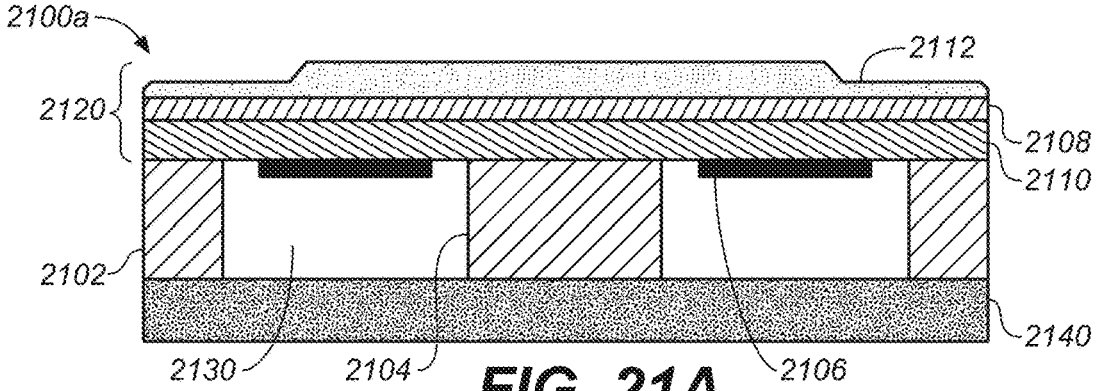
FIG. 21A is a diagram illustrating a PMUT device including an interior support and a non-uniform membrane, according to some embodiments.

FIG. 21A is a diagram illustrating a cross section of a PMUT device 2100*a* including an interior support and a non-uniform membrane, according to some embodiments. PMUT device 2100*a* has a non-uniform membrane 2120 positioned over a substrate 2140 to define a cavity 2130. The membrane 2120 is attached to a surrounding edge support 2102 and interior support 2104. Edge support 2102 and interior support 2104 are attached to a substrate 2140. The membrane 2120 is formed from multiple layers to have non-uniform mechanical and flexural properties. In the present embodiment, the membrane 2120 includes lower electrode 2106, piezoelectric layer 2110, upper electrode 2108, and a stiffening layer 2112 to mechanically stiffen the membrane 2120. The non-uniform stiffening layer 2112 is thinned along its peripheral region, such that a thickness in the peripheral region less than the thickness of the interior region of stiffening layer 2112.

Figure 21B:
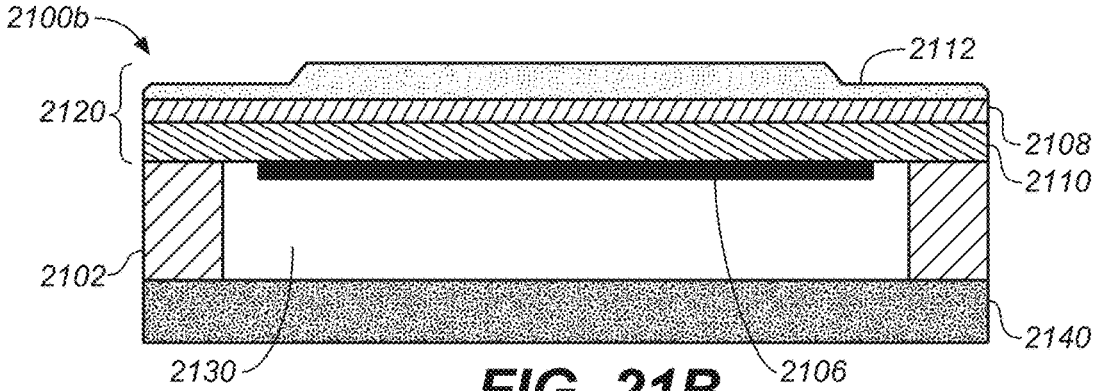
FIG. 21B is a diagram illustrating a PMUT device including a non-uniform membrane, according to some embodiments.

FIG. 21B is a diagram illustrating a cross section of a PMUT device 2100*b* which is similar to PMUT device 2100*a* of FIG. 21A, but does not include an interior support, according to some embodiments. PMUT device 2100*b* has a non-uniform membrane 2120 positioned over a substrate 2140 to define a cavity 2130. The membrane 2120 is attached to a surrounding edge support 2102. Edge support 2102 is attached to a substrate 2140. The membrane 2120 is formed from multiple layers to have non-uniform mechanical and flexural properties. In the present embodiment, the membrane 2120 includes lower electrode 2106, piezoelectric layer 2110, upper electrode 2108, and a stiffening layer 2112 to mechanically stiffen the membrane 2120. The non-uniform stiffening layer 2112 is thinned along its peripheral region, such that a thickness in the peripheral region less than the thickness of the interior region of stiffening layer 2112.

Figure 22:
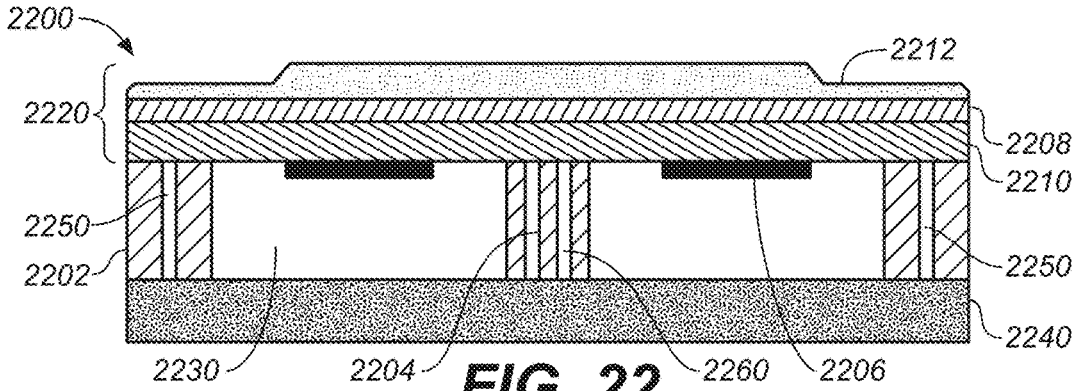
FIG. 22 is a diagram illustrating a PMUT device including an interior support and a non-uniform membrane, where the edge support structure and the interior support structure include voids, according to some embodiments.

FIG. 22 is a diagram illustrating a cross section of a PMUT device 2200 including an interior support and a non-uniform membrane, according to some embodiments. PMUT device 2200 has a non-uniform membrane 2220 positioned over a substrate 2240 to define a cavity 2230. The membrane 2220 is attached to a surrounding edge support 2202 and interior support 2204. Edge support 2202 and interior support 2204 is attached to a substrate 2240. Edge support 2202 includes at least one void 2250 and interior support 2204 includes at least one void 2260. Voids 2250 and 2260 operate to reduce the stiffness of edge support 2202 and interior support 2204, respectively, and allow edge support 2202 and interior support 2204 to be compliant, thereby increasing the deformation and movement of membrane 2220. The membrane 2220 is formed from multiple layers to have non-uniform mechanical and flexural properties. In the present embodiment, the membrane 2220 includes lower electrode 2206, piezoelectric layer 2210, upper electrode 2208, and a stiffening layer 2212 to mechanically stiffen the membrane 2220. The non-uniform stiffening layer 2212 is thinned along its peripheral region, such that a thickness in the peripheral region less than the thickness of the interior region of stiffening layer 2212.

Figure 23A:
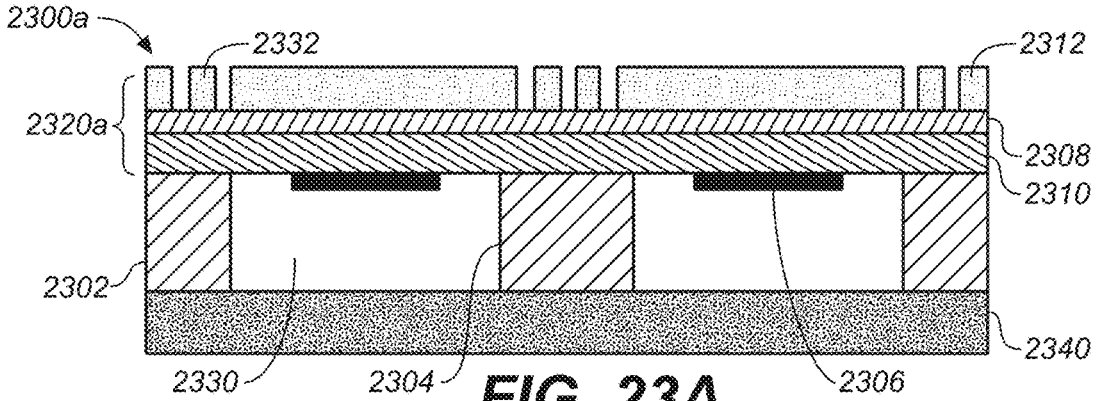
FIGS. 23A-C are diagrams illustrating a PMUT device including an interior support and a non-uniform membrane including voids, according to some embodiments.

FIG. 23A is a diagram illustrating a cross section of a PMUT device 2300*a* including an interior support and a non-uniform membrane, according to some embodiments. PMUT device 2300*a* has a non-uniform membrane 2320*a* positioned over a substrate 2340 to define a cavity 2330. The membrane 2320*a* is attached to a surrounding edge support 2302 and interior support 2304. Edge support 2302 and interior support 2304 is attached to a substrate 2340. The membrane 2320*a* is formed from multiple layers to have non-uniform mechanical and flexural properties. In the present embodiment, the membrane 2320*a* includes lower electrode 2306, piezoelectric layer 2310, upper electrode 2308, and a stiffening layer 2312 to mechanically stiffen the membrane 2320*a*. Membrane 2320*a* includes at least one void 2332 (e.g., notch or trench) extending into membrane 2320*a*. Voids 2332 operate to reduce the stiffness of the regions of membrane 2320*a* including voids 2332, and allow the regions of membrane 2320*a* including voids 2332 to be more compliant than the regions of membrane 2320 that do not include voids. As illustrated, voids 2332 extend through stiffening layer 2312. However, it should be appreciated that voids 2332 can extend through any depth of membrane 2320*a* (e.g., partially into stiffening layer 2312, completely through stiffening layer 2312, completely through stiffening layer 2312 and partially into piezoelectric layer 2310, so long as upper electrode 2308 and lower electrode 2306 are electrically conductive (e.g., electrical conductively it maintained around the voids).

Figure 23B:
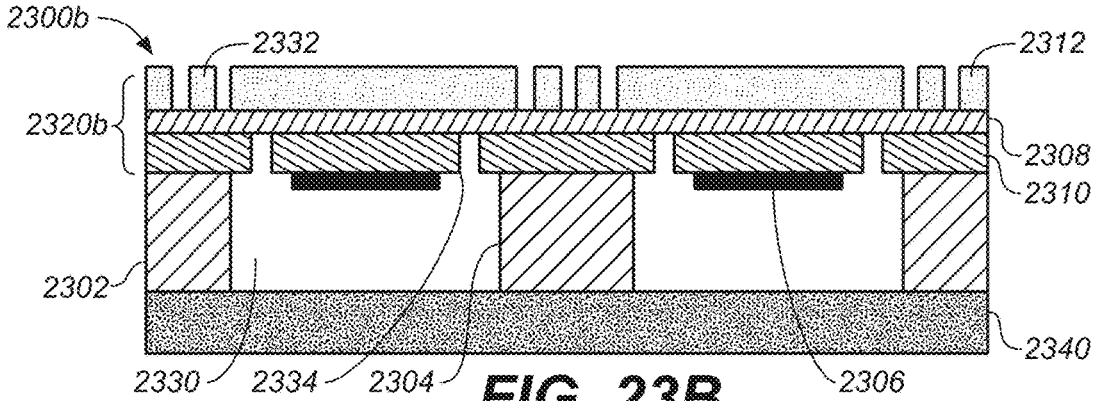

FIG. 23B is a diagram illustrating a cross section of a PMUT device 2300*b* including an interior support and a non-uniform membrane, according to some embodiments. PMUT device 2300*b* is similar to PMUT device 2300*a* of FIG. 23A, and has a non-uniform membrane 2320*b* positioned over a substrate 2340 to define a cavity 2330. In the present embodiment, membrane 2320*b* includes at least one void 2332 (e.g., notch or trench) extending into stiffening layer 2312 and at least one void 2334 extending into piezoelectric layer 2310. Voids 2332 and 2334 operate to reduce the stiffness of the regions of membrane 2320*b* including voids 2332 and 2334, and allow the regions of membrane 2320*b* including voids 2332 and 2334 to be more compliant than the regions of membrane 2320*b* that do not include voids. As illustrated, voids 2332 extend through stiffening layer 2312 and voids 2334 extend through piezoelectric layer 2334. However, it should be appreciated that voids 2332 and 2334 can extend through any depth of membrane 2320*b* so long as upper electrode 2308 and lower electrode 2306 are electrically conductive (e.g., electrical conductively it maintained around the voids).

Figure 23C:
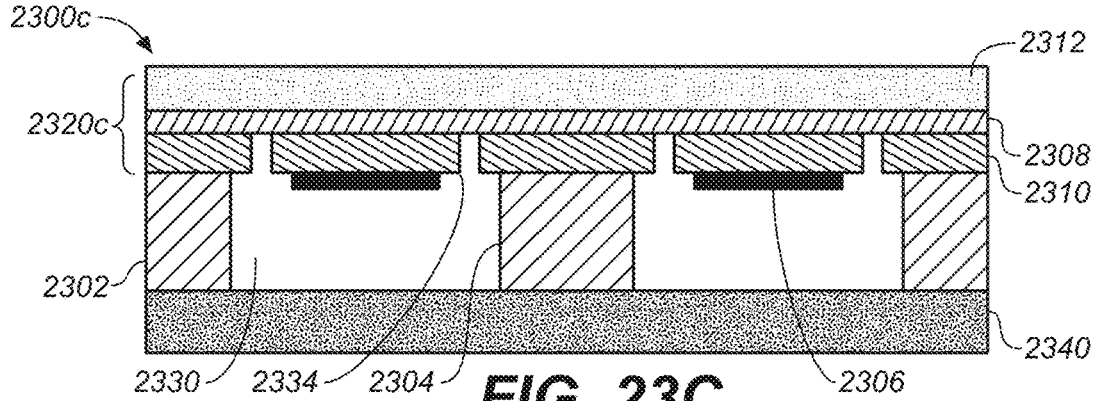

FIG. 23C is a diagram illustrating a cross section of a PMUT device 2300*c* including an interior support and a non-uniform membrane, according to some embodiments. PMUT device 2300*c* is similar to PMUT device 2300*a* of FIG. 23A and PMUT device 2300*b* of FIG. 23B, and has a non-uniform membrane 2320*c* positioned over a substrate 2340 to define a cavity 2330. In the present embodiment, membrane 2320*c* includes at least one void 2334 (e.g., notch or trench) extending into piezoelectric layer 2310. Voids 2334 operate to reduce the stiffness of the regions of membrane 2320*c* including voids 2334, and allow the regions of membrane 2320*c* including voids 2334 to be more compliant than the regions of membrane 2320*c* that do not include voids. As illustrated, voids 2334 extend through piezoelectric layer 2334. However, it should be appreciated that voids 2334 can extend through any depth of membrane 2320*c* so long as upper electrode 2308 and lower electrode 2306 are electrically conductive (e.g., electrical conductively it maintained around the voids).

FIGS. 24A-D illustrate top views of examples of alternative positioning of regions of different stiffness of a membrane, according to some embodiments. The various illustrated embodiments include regions of different stiffness of the membrane (e.g., relatively compliant region and a relatively rigid region). It should be appreciated that the regions of different stiffness can be a function of different materials, different thicknesses, different amounts of material, compliant anchors, or any combination thereof. Regions of a first stiffness formed as a portion of the membrane can be centrally positioned with respect to regions of a second stiffness of the membrane, but can also be positioned in a non-central, off-axis, or cantilevered manner. Continuous, single, dual, or multiple compliant structures can be used.

Figure 24A:
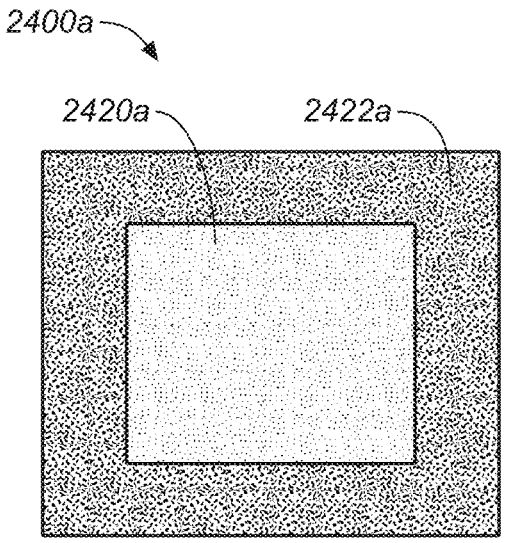
FIGS. 24A-D illustrate alternative positioning of regions of different stiffness of a membrane, according to some embodiments.
Figure 24B:
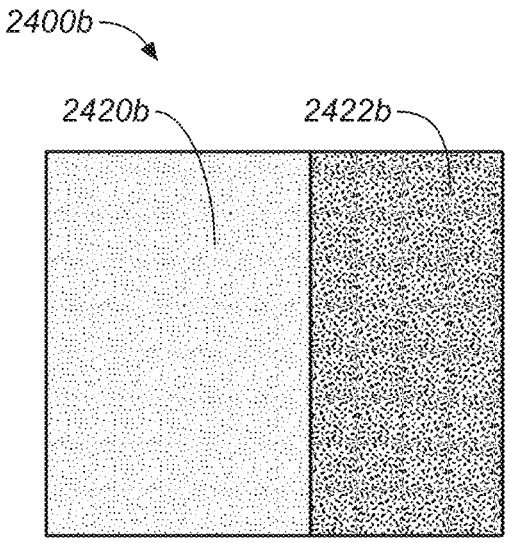
Figure 24C:
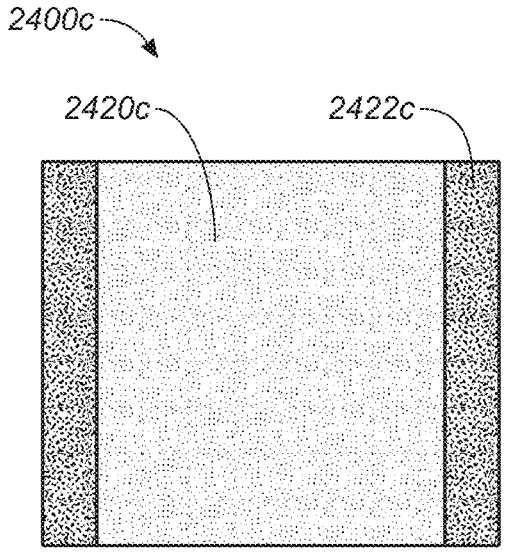
Figure 24D:
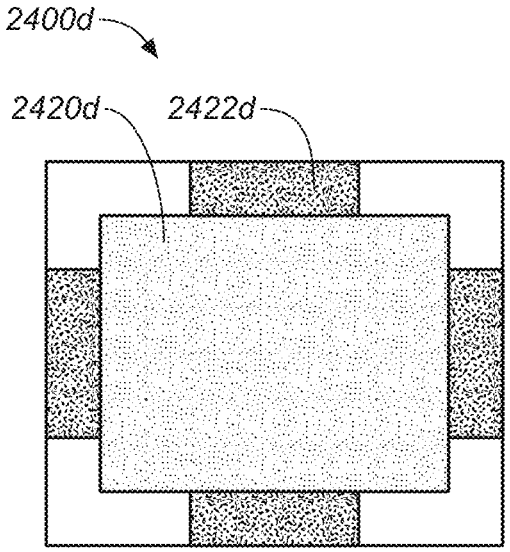

For example, as illustrated in FIG. 24A, membrane 2400*a* includes a peripheral region 2422*a* having a first stiffness supports an interior region 2420*a* having a second stiffness. In the example of FIG. 24B, membrane 2400*b* includes a first region 2420*b* having a first stiffness and a second region 2422*b* having a second stiffness, where first region 2420*b* and second region 2422*b* are side-by-side. In the example of FIG. 24C, opposing edges of membrane 2400*c* includes a first region 2420*c* having a first stiffness attached to a second region 2422*c* having a second stiffness, where first region 2420*c* supports second region 2422*c*. In the example of FIG. 24D, membrane 2400*d* includes a first region 2420*d* having a first stiffness and multiple, non-continuous second regions 2422*d* having a second stiffness, where second regions 2422*d* are along the periphery of membrane 2400*d*.

Figure 25:
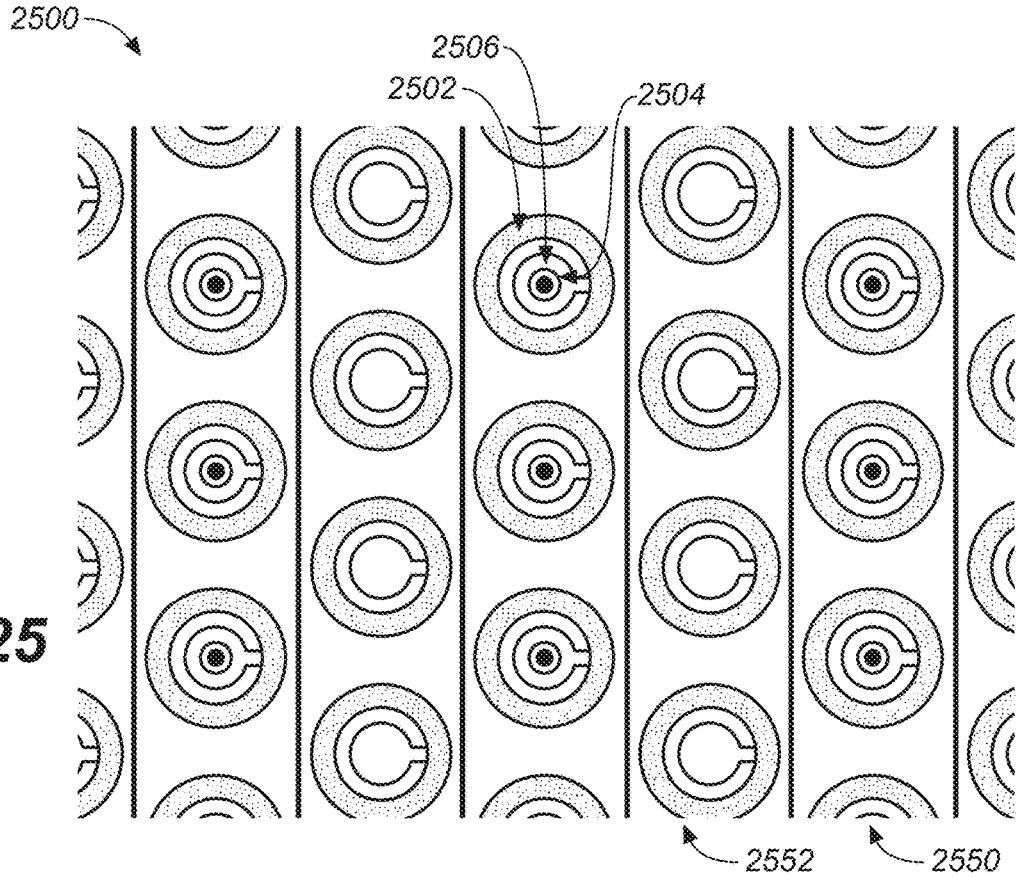
FIG. 25 illustrates an example array of circular-shaped PMUT devices, according to some embodiments.

FIG. 25 illustrates an example two-dimensional array 2500 of circular-shaped PMUT devices 2550 and 2552 formed from PMUT devices having a substantially circular shape similar to that discussed in conjunction with FIGS. 1, 2 and 5. Layout of circular surrounding edge support 2502, interior support 2504, and annular or ring shaped lower electrode 2506 surrounding the interior support 2504 are illustrated, while other continuous layers are not shown for clarity. As illustrated, array 2500 includes columns of circular-shaped PMUT devices that are offset. It should be appreciated that the circular-shaped PMUT devices may be closer together, such that edges of the columns of circular-shaped PMUT devices overlap. Moreover, it should be appreciated that circular-shaped PMUT devices may contact each other. In various embodiments, adjacent circular-shaped PMUT devices are electrically isolated. In other embodiments, groups of adjacent circular-shaped PMUT devices are electrically connected, where the groups of adjacent circular-shaped PMUT devices are electrically isolated.

In the illustrated embodiment, alternating PMUT device columns illustrate both center pinned PMUT devices 2550 and unpinned PMUT devices 2552. In one embodiment, unpinned PMUT devices 2552 have non-uniform membranes. In another embodiment, unpinned PMUT devices 2552 have non-uniform membranes with compliant attachment points along their respective peripheries.

What has been described above includes examples of the subject disclosure. It is, of course, not possible to describe every conceivable combination of components or methodologies for purposes of describing the subject matter, but it is to be appreciated that many further combinations and permutations of the subject disclosure are possible. Accordingly, the claimed subject matter is intended to embrace all such alterations, modifications, and variations that fall within the spirit and scope of the appended claims.

In particular and in regard to the various functions performed by the above described components, devices, circuits, systems and the like, the terms (including a reference to a "means") used to describe such components are intended to correspond, unless otherwise indicated, to any component which performs the specified function of the described component (e.g., a functional equivalent), even though not structurally equivalent to the disclosed structure, which performs the function in the herein illustrated embodiments of the claimed subject matter.

The aforementioned systems and components have been described with respect to interaction between several components. It can be appreciated that such systems and components can include those components or specified sub-components, some of the specified components or sub-components, and/or additional components, and according to various permutations and combinations of the foregoing. Sub-components can also be implemented as components communicatively coupled to other components rather than included within parent components (hierarchical). Additionally, it should be noted that one or more components may be combined into a single component providing aggregate functionality or divided into several separate sub-components. Any components described herein may also interact with one or more other components not specifically described herein.

In addition, while a particular feature of the subject innovation may have been disclosed with respect to only one of several implementations, such feature may be combined with one or more other features of the other implementations as may be desired and advantageous for any given or particular application. Furthermore, to the extent that the terms "includes," "including," "has," "contains," variants thereof, and other similar words are used in either the detailed description or the claims, these terms are intended to be inclusive in a manner similar to the term "comprising" as an open transition word without precluding any additional or other elements.

Thus, the embodiments and examples set forth herein were presented in order to best explain various selected embodiments of the present invention and its particular application and to thereby enable those skilled in the art to make and use embodiments of the invention. However, those skilled in the art will recognize that the foregoing description and examples have been presented for the purposes of illustration and example only. The description as set forth is not intended to be exhaustive or to limit the embodiments of the invention to the precise form disclosed.

What is claimed is:

1. A Piezoelectric Micromachined Ultrasonic Transducer (PMUT) device comprising:
- a substrate;
- an edge support structure connected to the substrate; and
- a membrane connected to the edge support structure such that a cavity is defined between the membrane and the substrate, the membrane configured to allow movement at ultrasonic frequencies, the membrane having non-uniform stiffness, wherein a peripheral region of the membrane has a first stiffness and an interior region of the membrane has a second stiffness, the peripheral region overlying the edge support structure, the membrane comprising:
  - a piezoelectric layer;
  - a first electrode and a second electrode coupled to opposing sides of the piezoelectric layer; and
  - a mechanical support layer coupled to the first electrode or the second electrode, the mechanical support layer comprising at least one void in the peripheral region, such that the first stiffness is less than the second stiffness.

2. The PMUT of claim 1, wherein a thickness of the peripheral region of the membrane is different than a thickness of the interior region of the membrane.

3. The PMUT of claim 1, wherein the mechanical support layer defines a continuous layer, and wherein a thickness of the mechanical support layer of the peripheral region of the membrane is different than a thickness of the mechanical support layer of the interior region of the membrane.

4. The PMUT of claim 1, wherein the interior region of the membrane comprises a void.

5. The PMUT of claim 1, wherein the peripheral region of the membrane comprises a material not comprised within the interior region of the membrane.

6. The PMUT of claim 1, wherein the interior region of the membrane comprises a material not comprised within the peripheral region of the membrane.

7. The PMUT of claim 1, the membrane further comprising:
- a compliant anchor disposed within the peripheral region of the membrane such that the membrane is connected to the edge support structure via the compliant anchor, the compliant anchor having the first stiffness.

8. The PMUT of claim 7, wherein the compliant anchor comprises a different material makeup than a portion of the membrane not comprising the compliant anchor.

9. The PMUT of claim 1, wherein the edge support structure is structurally compliant.

10. The PMUT of claim 1, further comprising:
- an interior support structure disposed within the cavity and connected to the substrate and the membrane.

11. The PMUT of claim 10, wherein the membrane comprises voids in the peripheral region of the membrane and a region of the membrane connected to the interior support structure.

12. The PMUT of claim 10, wherein the interior support structure is structurally compliant.

13. The PMUT of claim 1, wherein the membrane is non-planar.

14. Piezoelectric Micromachined Ultrasonic Transducer (PMUT) device comprising:
- a substrate;
- a structurally compliant edge support structure connected to the substrate; and
- a membrane connected to the structurally compliant edge support structure such that a cavity is defined between the membrane and the substrate, the membrane configured to allow movement at ultrasonic frequencies, the membrane comprising:
  - a piezoelectric layer;
  - a first electrode and a second electrode coupled to opposing sides of the piezoelectric layer; and
  - a mechanical support layer coupled to the first electrode or the second electrode;
- wherein the structurally compliant edge support structure provides for non-uniform movement of the membrane.

15. The PMUT of claim 14, wherein the structurally compliant edge support structure comprises a compliant anchor for providing the non-uniform movement of the membrane.

16. The PMUT of claim 14, wherein the structurally compliant edge support structure comprises voids.

17. The PMUT of claim 14, wherein the membrane has non-uniform stiffness.

18. The PMUT of claim 14, further comprising:
- an interior support structure disposed within the cavity and connected to the substrate and the membrane.

19. The PMUT of claim 18, wherein the interior support structure is structurally compliant.

20. A Piezoelectric Micromachined Ultrasonic Transducer (PMUT) array comprising:
- a plurality of PMUT devices, wherein at least one PMUT device of the plurality of PMUT devices comprises:
  - a substrate;
  - an edge support structure connected to the substrate; and
  - a membrane connected to the edge support structure such that a cavity is defined between the membrane and the substrate, the membrane configured to allow movement at ultrasonic frequencies, the membrane having non-uniform stiffness, wherein a peripheral region of the membrane has a first stiffness and an interior region of the membrane has a second stiffness, the membrane comprising:
    - a piezoelectric layer;
    - a first electrode and a second electrode coupled to opposing sides of the piezoelectric layer; and
    - a mechanical support layer coupled to the first electrode or the second electrode, wherein the mechanical support layer comprises different materials at the peripheral region and the interior region; and an acoustic coupling layer overlying the plurality of PMUT devices.

21. The PMUT array of claim 20, wherein a thickness of the peripheral region of the membrane is different than a thickness of the interior region of the membrane.

22. The PMUT array of claim 20, wherein the peripheral region of the membrane comprises a material not comprised within the interior region of the membrane.

23. The PMUT array of claim 20, wherein the interior region of the membrane comprises a material not comprised within the peripheral region of the membrane.

24. The PMUT array of claim 20, the at least one PMUT device further comprising:

a compliant anchor disposed within the peripheral region of the membrane such that the membrane is connected to the edge support structure via the compliant anchor, the compliant anchor having a third stiffness.

25. The PMUT array of claim 20, wherein the at least one PMUT device of the plurality of PMUT devices further comprises:

an interior support structure disposed within the cavity and connected to the substrate and the membrane.

* * * * *